US009978297B2

(12) United States Patent
Jaffari et al.

(10) Patent No.: US 9,978,297 B2
(45) Date of Patent: May 22, 2018

(54) ADAPTIVE FEEDBACK SYSTEM FOR COMPENSATING FOR AGING PIXEL AREAS WITH ENHANCED ESTIMATION SPEED

(71) Applicant: Ignis Innovation Inc., Waterloo (CA)

(72) Inventors: Javid Jaffari, North York (CA); Gholamreza Chaji, Waterloo (CA); Abdorreza Heidari, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days. days.

(21) Appl. No.: 15/466,468

(22) Filed: Mar. 22, 2017

(65) Prior Publication Data

US 2017/0193873 A1 Jul. 6, 2017

Related U.S. Application Data

(63) Continuation of application No. 15/262,266, filed on Sep. 12, 2016, now Pat. No. 9,640,112, which is a (Continued)

(51) Int. Cl.
*G09G 3/00* (2006.01)
*G09G 3/3208* (2016.01)
(Continued)

(52) U.S. Cl.
CPC ..... *G09G 3/006* (2013.01); *G09G 3/3208* (2013.01); *G09G 3/3233* (2013.01);
(Continued)

(58) Field of Classification Search
None
See application file for complete search history.

(56) References Cited

U.S. PATENT DOCUMENTS 3,506,851 A 4/1970 Polkinghorn
3,774,055 A 11/1973 Bapat
(Continued)

FOREIGN PATENT DOCUMENTS

CA 1 294 034 1/1992
CA 2 109 951 11/1992
(Continued)

OTHER PUBLICATIONS

Ahnood : "Effect of threshold voltage instability on field effect mobility in thin film transistors deduced from constant current measurements"; dated Aug. 2009.
(Continued)

*Primary Examiner* — Gustavo Polo
(74) *Attorney, Agent, or Firm* — Nixon Peabody LLP

(57) ABSTRACT

A local priority-based scanning scheme that focuses scanning to areas of a display panel whose measured characteristics are under continuous change (e.g., aging or relaxation). The algorithm identifies areas or regions needing compensation, using a current measurement from a single pixel in an area as a candidate to determine whether the rest of the region needs further compensation. The algorithm thus detects newly changed areas quickly, focusing time-consuming measurements on those areas that need high attention. Optionally, neighboring pixels sharing the same state (e.g., aging or overcompensated) as the measured pixel can be adjusted automatically given the likelihood that the neighboring pixels will also require compensation if the measured pixel needs compensation.

18 Claims, 9 Drawing Sheets

Related U.S. Application Data continuation of application No. 13/291,486, filed on Nov. 8, 2011, now Pat. No. 9,466,240.

(60) Provisional application No. 61/490,309, filed on May 26, 2011.

(51) Int. Cl.

| | |
|---|---|
| ***G09G 3/3233*** | (2016.01) |
| ***G09G 3/3258*** | (2016.01) |
| ***G09G 3/3266*** | (2016.01) |
| ***G09G 3/3283*** | (2016.01) |

(52) U.S. Cl.

CPC ..... *G09G 3/3258* (2013.01); *G09G 3/3266* (2013.01); *G09G 3/3283* (2013.01); *G09G 2310/0254* (2013.01); *G09G 2310/0256* (2013.01); *G09G 2310/08* (2013.01); *G09G 2320/029* (2013.01); *G09G 2320/0233* (2013.01); *G09G 2320/0242* (2013.01); *G09G 2320/043* (2013.01); *G09G 2320/045* (2013.01); *G09G 2320/0666* (2013.01); *G09G 2360/145* (2013.01)

(56) References Cited

U.S. PATENT DOCUMENTS

| | | | |
|---|---|---|---|
| 4,090,096 | A | 5/1978 | Nagami |
| 4,160,934 | A | 7/1979 | Kirsch |
| 4,354,162 | A | 10/1982 | Wright |
| 4,943,956 | A | 7/1990 | Noro |
| 4,996,523 | A | 2/1991 | Bell |
| 5,153,420 | A | 10/1992 | Hack |
| 5,198,803 | A | 3/1993 | Shie |
| 5,204,661 | A | 4/1993 | Hack |
| 5,266,515 | A | 11/1993 | Robb |
| 5,489,918 | A | 2/1996 | Mosier |
| 5,498,880 | A | 3/1996 | Lee |
| 5,557,342 | A | 9/1996 | Eto |
| 5,572,444 | A | 11/1996 | Lentz |
| 5,589,847 | A | 12/1996 | Lewis |
| 5,619,033 | A | 4/1997 | Weisfield |
| 5,648,276 | A | 7/1997 | Hara |
| 5,670,973 | A | 9/1997 | Bassetti |
| 5,684,365 | A | 11/1997 | Tang |
| 5,691,783 | A | 11/1997 | Numao |
| 5,714,968 | A | 2/1998 | Ikeda |
| 5,723,950 | A | 3/1998 | Wei |
| 5,744,824 | A | 4/1998 | Kousai |
| 5,745,660 | A | 4/1998 | Kolpatzik |
| 5,748,160 | A | 5/1998 | Shieh |
| 5,815,303 | A | 9/1998 | Berlin |
| 5,870,071 | A | 2/1999 | Kawahata |
| 5,874,803 | A | 2/1999 | Garbuzov |
| 5,880,582 | A | 3/1999 | Sawada |
| 5,903,248 | A | 5/1999 | Irwin |
| 5,917,280 | A | 6/1999 | Burrows |
| 5,923,794 | A | 7/1999 | McGrath |
| 5,945,972 | A | 8/1999 | Okumura |
| 5,949,398 | A | 9/1999 | Kim |
| 5,952,789 | A | 9/1999 | Stewart |
| 5,952,991 | A | 9/1999 | Akiyama |
| 5,982,104 | A | 11/1999 | Sasaki |
| 5,990,629 | A | 11/1999 | Yamada |
| 6,023,259 | A | 2/2000 | Howard |
| 6,069,365 | A | 5/2000 | Chow |
| 6,081,073 | A | 6/2000 | Salam |
| 6,091,203 | A | 7/2000 | Kawashima |
| 6,097,360 | A | 8/2000 | Holloman |
| 6,144,222 | A | 11/2000 | Ho |
| 6,177,915 | B1 | 1/2001 | Beeteson |
| 6,229,506 | B1 | 5/2001 | Dawson |
| 6,229,508 | B1 | 5/2001 | Kane |
| 6,246,180 | B1 | 6/2001 | Nishigaki |
| 6,252,248 | B1 | 6/2001 | Sano |
| 6,259,424 | B1 | 7/2001 | Kurogane |
| 6,262,589 | B1 | 7/2001 | Tamukai |
| 6,271,825 | B1 | 8/2001 | Greene |
| 6,288,696 | B1 | 9/2001 | Holloman |
| 6,304,039 | B1 | 10/2001 | Appelberg |
| 6,307,322 | B1 | 10/2001 | Dawson |
| 6,310,962 | B1 | 10/2001 | Chung |
| 6,320,325 | B1 | 11/2001 | Cok |
| 6,323,631 | B1 | 11/2001 | Juang |
| 6,356,029 | B1 | 3/2002 | Hunter |
| 6,373,454 | B1 | 4/2002 | Knapp |
| 6,392,617 | B1 | 5/2002 | Gleason |
| 6,414,661 | B1 | 7/2002 | Shen |
| 6,417,825 | B1 | 7/2002 | Stewart |
| 6,433,488 | B1 | 8/2002 | Bu |
| 6,437,106 | B1 | 8/2002 | Stoner |
| 6,445,369 | B1 | 9/2002 | Yang |
| 6,475,845 | B2 | 11/2002 | Kimura |
| 6,501,098 | B2 | 12/2002 | Yamazaki |
| 6,501,466 | B1 | 12/2002 | Yamagishi |
| 6,518,962 | B2 | 2/2003 | Kimura |
| 6,522,315 | B2 | 2/2003 | Ozawa |
| 6,525,683 | B1 | 2/2003 | Gu |
| 6,531,827 | B2 | 3/2003 | Kawashima |
| 6,542,138 | B1 | 4/2003 | Shannon |
| 6,555,420 | B1 | 4/2003 | Yamazaki |
| 6,580,408 | B1 | 6/2003 | Bae |
| 6,580,657 | B2 | 6/2003 | Sanford |
| 6,583,398 | B2 | 6/2003 | Harkin |
| 6,583,775 | B1 | 6/2003 | Sekiya |
| 6,594,606 | B2 | 7/2003 | Everitt |
| 6,618,030 | B2 | 9/2003 | Kane |
| 6,639,244 | B1 | 10/2003 | Yamazaki |
| 6,668,645 | B1 | 12/2003 | Gilmour |
| 6,677,713 | B1 | 1/2004 | Sung |
| 6,680,580 | B1 | 1/2004 | Sung |
| 6,687,266 | B1 | 2/2004 | Ma |
| 6,690,000 | B1 | 2/2004 | Muramatsu |
| 6,690,344 | B1 | 2/2004 | Takeuchi |
| 6,693,388 | B2 | 2/2004 | Oomura |
| 6,693,610 | B2 | 2/2004 | Shannon |
| 6,697,057 | B2 | 2/2004 | Koyama |
| 6,720,942 | B2 | 4/2004 | Lee |
| 6,724,151 | B2 | 4/2004 | Yoo |
| 6,734,636 | B2 | 5/2004 | Sanford |
| 6,738,034 | B2 | 5/2004 | Kaneko |
| 6,738,035 | B1 | 5/2004 | Fan |
| 6,753,655 | B2 | 6/2004 | Shih |
| 6,753,834 | B2 | 6/2004 | Mikami |
| 6,756,741 | B2 | 6/2004 | Li |
| 6,756,952 | B1 | 6/2004 | Decaux |
| 6,756,958 | B2 | 6/2004 | Furuhashi |
| 6,771,028 | B1 | 8/2004 | Winters |
| 6,777,712 | B2 | 8/2004 | Sanford |
| 6,777,888 | B2 | 8/2004 | Kondo |
| 6,781,567 | B2 | 8/2004 | Kimura |
| 6,806,497 | B2 | 10/2004 | Jo |
| 6,806,638 | B2 | 10/2004 | Lih et al. |
| 6,806,857 | B2 | 10/2004 | Sempel |
| 6,809,706 | B2 | 10/2004 | Shimoda |
| 6,815,975 | B2 | 11/2004 | Nara |
| 6,828,950 | B2 | 12/2004 | Koyama |
| 6,853,371 | B2 | 2/2005 | Miyajima |
| 6,859,193 | B1 | 2/2005 | Yumoto |
| 6,873,117 | B2 | 3/2005 | Ishizuka |
| 6,876,346 | B2 | 4/2005 | Anzai |
| 6,885,356 | B2 | 4/2005 | Hashimoto |
| 6,900,485 | B2 | 5/2005 | Lee |
| 6,903,734 | B2 | 6/2005 | Eu |
| 6,909,243 | B2 | 6/2005 | Inukai |
| 6,909,419 | B2 | 6/2005 | Zavracky |
| 6,911,960 | B1 | 6/2005 | Yokoyama |
| 6,911,964 | B2 | 6/2005 | Lee |
| 6,914,448 | B2 | 7/2005 | Jinno |
| 6,919,871 | B2 | 7/2005 | Kwon |
| 6,924,602 | B2 | 8/2005 | Komiya |
| 6,937,215 | B2 | 8/2005 | Lo |
| 6,937,220 | B2 | 8/2005 | Kitaura |

(56) References Cited

U.S. PATENT DOCUMENTS 6,940,214 B1 9/2005 Komiya
6,943,500 B2 9/2005 LeChevalier
6,947,022 B2 9/2005 McCartney
6,954,194 B2 10/2005 Matsumoto
6,956,547 B2 10/2005 Bae
6,975,142 B2 12/2005 Azami
6,975,332 B2 12/2005 Arnold
6,995,510 B2 2/2006 Murakami
6,995,519 B2 2/2006 Arnold
7,023,408 B2 4/2006 Chen
7,027,015 B2 4/2006 Booth, Jr.
7,027,078 B2 4/2006 Reihl
7,034,793 B2 4/2006 Sekiya
7,038,392 B2 5/2006 Libsch
7,057,359 B2 6/2006 Hung
7,061,451 B2 6/2006 Kimura
7,064,733 B2 6/2006 Cok
7,071,932 B2 7/2006 Libsch
7,088,051 B1 8/2006 Cok
7,088,052 B2 8/2006 Kimura
7,102,378 B2 9/2006 Kuo
7,106,285 B2 9/2006 Naugler
7,112,820 B2 9/2006 Chang
7,116,058 B2 10/2006 Lo
7,119,493 B2 10/2006 Fryer
7,122,835 B1 10/2006 Ikeda
7,127,380 B1 10/2006 Iverson
7,129,914 B2 10/2006 Knapp
7,161,566 B2 1/2007 Cok
7,164,417 B2 1/2007 Cok
7,193,589 B2 3/2007 Yoshida
7,224,332 B2 5/2007 Cok
7,227,519 B1 6/2007 Kawase
7,245,277 B2 7/2007 Ishizuka
7,248,236 B2 7/2007 Nathan
7,262,753 B2 8/2007 Tanghe
7,274,363 B2 9/2007 Ishizuka
7,310,092 B2 12/2007 Imamura
7,315,295 B2 1/2008 Kimura
7,321,348 B2 1/2008 Cok
7,339,560 B2 3/2008 Sun
7,355,574 B1 4/2008 Leon
7,358,941 B2 4/2008 Ono
7,368,868 B2 5/2008 Sakamoto
7,397,485 B2 7/2008 Miller
7,411,571 B2 8/2008 Huh
7,414,600 B2 8/2008 Nathan
7,423,617 B2 9/2008 Giraldo
7,453,054 B2 11/2008 Lee
7,474,285 B2 1/2009 Kimura
7,502,000 B2 3/2009 Yuki
7,528,812 B2 5/2009 Tsuge
7,535,449 B2 5/2009 Miyazawa
7,554,512 B2 6/2009 Steer
7,569,849 B2 8/2009 Nathan
7,576,718 B2 8/2009 Miyazawa
7,580,012 B2 8/2009 Kim
7,589,707 B2 9/2009 Chou
7,609,239 B2 10/2009 Chang
7,619,594 B2 11/2009 Hu
7,619,597 B2 11/2009 Nathan
7,633,470 B2 12/2009 Kane
7,656,370 B2 2/2010 Schneider
7,800,558 B2 9/2010 Routley
7,847,764 B2 12/2010 Cok
7,859,492 B2 12/2010 Kohno
7,868,859 B2 1/2011 Tomida
7,876,294 B2 1/2011 Sasaki
7,924,249 B2 4/2011 Nathan
7,932,883 B2 4/2011 Klompenhouwer
7,969,390 B2 6/2011 Yoshida
7,978,187 B2 7/2011 Nathan
7,994,712 B2 8/2011 Sung
8,026,876 B2 9/2011 Nathan
8,049,420 B2 11/2011 Tamura
8,077,123 B2 12/2011 Naugler, Jr.
8,115,707 B2 2/2012 Nathan
8,208,084 B2 6/2012 Lin
8,223,177 B2 7/2012 Nathan
8,232,939 B2 7/2012 Nathan
8,259,044 B2 9/2012 Nathan
8,264,431 B2 9/2012 Bulovic
8,279,143 B2 10/2012 Nathan
8,339,386 B2 12/2012 Leon
8,441,206 B2 5/2013 Myers
8,493,296 B2 7/2013 Ogawa
2001/0002703 A1 6/2001 Koyama
2001/0009283 A1 7/2001 Arao
2001/0024181 A1 9/2001 Kubota
2001/0024186 A1 9/2001 Kane
2001/0026257 A1 10/2001 Kimura
2001/0030323 A1 10/2001 Ikeda
2001/0035863 A1 11/2001 Kimura
2001/0038367 A1 11/2001 Inukai
2001/0040541 A1 11/2001 Yoneda
2001/0043173 A1 11/2001 Troutman
2001/0045929 A1 11/2001 Prache
2001/0052606 A1 12/2001 Sempel
2001/0052940 A1 12/2001 Hagihara
2002/0000576 A1 1/2002 Inukai
2002/0011796 A1 1/2002 Koyama
2002/0011799 A1 1/2002 Kimura
2002/0012057 A1 1/2002 Kimura
2002/0014851 A1 2/2002 Tai
2002/0018034 A1 2/2002 Ohki
2002/0030190 A1 3/2002 Ohtani
2002/0047565 A1 4/2002 Nara
2002/0052086 A1 5/2002 Maeda
2002/0067134 A1 6/2002 Kawashima
2002/0084463 A1 7/2002 Sanford
2002/0101152 A1 8/2002 Kimura
2002/0101172 A1 8/2002 Bu
2002/0105279 A1 8/2002 Kimura
2002/0117722 A1 8/2002 Osada
2002/0122308 A1 9/2002 Ikeda
2002/0158587 A1 10/2002 Komiya
2002/0158666 A1 10/2002 Azami
2002/0158823 A1 10/2002 Zavracky
2002/0167471 A1 11/2002 Everitt
2002/0167474 A1 11/2002 Everitt
2002/0180369 A1 12/2002 Koyama
2002/0180721 A1 12/2002 Kimura
2002/0181276 A1 12/2002 Yamazaki
2002/0186214 A1 12/2002 Siwinski
2002/0190924 A1 12/2002 Asano
2002/0190971 A1 12/2002 Nakamura
2002/0195967 A1 12/2002 Kim
2002/0195968 A1 12/2002 Sanford
2003/0020413 A1 1/2003 Oomura
2003/0030603 A1 2/2003 Shimoda
2003/0043088 A1 3/2003 Booth
2003/0057895 A1 3/2003 Kimura
2003/0058226 A1 3/2003 Bertram
2003/0062524 A1 4/2003 Kimura
2003/0063081 A1 4/2003 Kimura
2003/0071821 A1 4/2003 Sundahl
2003/0076048 A1 4/2003 Rutherford
2003/0090447 A1 5/2003 Kimura
2003/0090481 A1 5/2003 Kimura
2003/0107560 A1 6/2003 Yumoto
2003/0111966 A1 6/2003 Mikami
2003/0122745 A1 7/2003 Miyazawa
2003/0122813 A1 7/2003 Ishizuki
2003/0142088 A1 7/2003 Lechevalier
2003/0151569 A1 8/2003 Lee
2003/0156101 A1 8/2003 Le Chevalier
2003/0174152 A1 9/2003 Noguchi
2003/0179626 A1 9/2003 Sanford
2003/0185438 A1 10/2003 Osawa
2003/0197663 A1 10/2003 Lee
2003/0210256 A1 11/2003 Mori
2003/0230141 A1 12/2003 Gilmour
2003/0230980 A1 12/2003 Forrest
2003/0231148 A1 12/2003 Lin

(56) References Cited

U.S. PATENT DOCUMENTS

| | | | |
|---|---|---|---|
| 2004/0032382 | A1 | 2/2004 | Cok |
| 2004/0041750 | A1 | 3/2004 | Abe |
| 2004/0066357 | A1 | 4/2004 | Kawasaki |
| 2004/0070557 | A1 | 4/2004 | Asano |
| 2004/0070565 | A1 | 4/2004 | Nayar |
| 2004/0090186 | A1 | 5/2004 | Kanauchi |
| 2004/0090400 | A1 | 5/2004 | Yoo |
| 2004/0095297 | A1 | 5/2004 | Libsch |
| 2004/0100427 | A1 | 5/2004 | Miyazawa |
| 2004/0108518 | A1 | 6/2004 | Jo |
| 2004/0135749 | A1 | 7/2004 | Kondakov |
| 2004/0140982 | A1 | 7/2004 | Pate |
| 2004/0145547 | A1 | 7/2004 | Oh |
| 2004/0150592 | A1 | 8/2004 | Mizukoshi |
| 2004/0150594 | A1 | 8/2004 | Koyama |
| 2004/0150595 | A1 | 8/2004 | Kasai |
| 2004/0155841 | A1 | 8/2004 | Kasai |
| 2004/0174347 | A1 | 9/2004 | Sun |
| 2004/0174349 | A1 | 9/2004 | Libsch |
| 2004/0174354 | A1 | 9/2004 | Ono |
| 2004/0178743 | A1 | 9/2004 | Miller |
| 2004/0183759 | A1 | 9/2004 | Stevenson |
| 2004/0196275 | A1 | 10/2004 | Hattori |
| 2004/0207615 | A1 | 10/2004 | Yumoto |
| 2004/0227697 | A1 | 11/2004 | Mori |
| 2004/0233125 | A1 | 11/2004 | Tanghe |
| 2004/0239596 | A1 | 12/2004 | Ono |
| 2004/0252089 | A1 | 12/2004 | Ono |
| 2004/0257313 | A1 | 12/2004 | Kawashima |
| 2004/0257353 | A1 | 12/2004 | Imamura |
| 2004/0257355 | A1 | 12/2004 | Naugler |
| 2004/0263437 | A1 | 12/2004 | Hattori |
| 2004/0263444 | A1 | 12/2004 | Kimura |
| 2004/0263445 | A1 | 12/2004 | Inukai |
| 2004/0263541 | A1 | 12/2004 | Takeuchi |
| 2005/0007355 | A1 | 1/2005 | Miura |
| 2005/0007357 | A1 | 1/2005 | Yamashita |
| 2005/0007392 | A1 | 1/2005 | Kasai |
| 2005/0017650 | A1 | 1/2005 | Fryer |
| 2005/0024081 | A1 | 2/2005 | Kuo |
| 2005/0024393 | A1 | 2/2005 | Kondo |
| 2005/0030267 | A1 | 2/2005 | Tanghe |
| 2005/0057484 | A1 | 3/2005 | Diefenbaugh |
| 2005/0057580 | A1 | 3/2005 | Yamano |
| 2005/0067970 | A1 | 3/2005 | Libsch |
| 2005/0067971 | A1 | 3/2005 | Kane |
| 2005/0068270 | A1 | 3/2005 | Awakura |
| 2005/0068275 | A1 | 3/2005 | Kane |
| 2005/0073264 | A1 | 4/2005 | Matsumoto |
| 2005/0083323 | A1 | 4/2005 | Suzuki |
| 2005/0088103 | A1 | 4/2005 | Kageyama |
| 2005/0110420 | A1 | 5/2005 | Arnold |
| 2005/0110807 | A1 | 5/2005 | Chang |
| 2005/0122294 | A1 | 6/2005 | Ben-David |
| 2005/0140598 | A1 | 6/2005 | Kim |
| 2005/0140610 | A1 | 6/2005 | Smith |
| 2005/0145891 | A1 | 7/2005 | Abe |
| 2005/0156831 | A1 | 7/2005 | Yamazaki |
| 2005/0162079 | A1 | 7/2005 | Sakamoto |
| 2005/0168416 | A1 | 8/2005 | Hashimoto |
| 2005/0179626 | A1 | 8/2005 | Yuki |
| 2005/0179628 | A1 | 8/2005 | Kimura |
| 2005/0185200 | A1 | 8/2005 | Tobol |
| 2005/0200575 | A1 | 9/2005 | Kim |
| 2005/0206590 | A1 | 9/2005 | Sasaki |
| 2005/0212787 | A1 | 9/2005 | Noguchi |
| 2005/0219184 | A1 | 10/2005 | Zehner |
| 2005/0225683 | A1 | 10/2005 | Nozawa |
| 2005/0248515 | A1 | 11/2005 | Naugler |
| 2005/0269959 | A1 | 12/2005 | Uchino |
| 2005/0269960 | A1 | 12/2005 | Ono |
| 2005/0280615 | A1 | 12/2005 | Cok |
| 2005/0280766 | A1 | 12/2005 | Johnson |
| 2005/0285822 | A1 | 12/2005 | Reddy |
| 2005/0285825 | A1 | 12/2005 | Eom |
| 2006/0001613 | A1 | 1/2006 | Routley |
| 2006/0007072 | A1 | 1/2006 | Choi |
| 2006/0007249 | A1 | 1/2006 | Reddy |
| 2006/0012310 | A1 | 1/2006 | Chen |
| 2006/0012311 | A1 | 1/2006 | Ogawa |
| 2006/0015272 | A1 | 1/2006 | Giraldo et al. |
| 2006/0022305 | A1 | 2/2006 | Yamashita |
| 2006/0027807 | A1 | 2/2006 | Nathan |
| 2006/0030084 | A1 | 2/2006 | Young |
| 2006/0038758 | A1 | 2/2006 | Routley |
| 2006/0038762 | A1 | 2/2006 | Chou |
| 2006/0044227 | A1 | 3/2006 | Hadcock |
| 2006/0066533 | A1 | 3/2006 | Sato |
| 2006/0077135 | A1 | 4/2006 | Cok |
| 2006/0077142 | A1 | 4/2006 | Kwon |
| 2006/0082523 | A1 | 4/2006 | Guo |
| 2006/0092185 | A1 | 5/2006 | Jo |
| 2006/0097628 | A1 | 5/2006 | Suh |
| 2006/0097631 | A1 | 5/2006 | Lee |
| 2006/0103611 | A1 | 5/2006 | Choi |
| 2006/0125740 | A1 | 6/2006 | Shirasaki et al. |
| 2006/0149493 | A1 | 7/2006 | Sambandan |
| 2006/0170623 | A1 | 8/2006 | Naugler, Jr. |
| 2006/0176250 | A1 | 8/2006 | Nathan |
| 2006/0208961 | A1 | 9/2006 | Nathan |
| 2006/0208971 | A1 | 9/2006 | Deane |
| 2006/0214888 | A1 | 9/2006 | Schneider |
| 2006/0231740 | A1 | 10/2006 | Kasai |
| 2006/0232522 | A1 | 10/2006 | Roy |
| 2006/0244697 | A1 | 11/2006 | Lee |
| 2006/0261841 | A1 | 11/2006 | Fish |
| 2006/0273997 | A1 | 12/2006 | Nathan |
| 2006/0279481 | A1 | 12/2006 | Haruna |
| 2006/0284801 | A1 | 12/2006 | Yoon |
| 2006/0284802 | A1 | 12/2006 | Kohno |
| 2006/0284895 | A1 | 12/2006 | Marcu |
| 2006/0290618 | A1 | 12/2006 | Goto |
| 2007/0001937 | A1 | 1/2007 | Park |
| 2007/0001939 | A1 | 1/2007 | Hashimoto |
| 2007/0008251 | A1 | 1/2007 | Kohno |
| 2007/0008268 | A1 | 1/2007 | Park |
| 2007/0008297 | A1 | 1/2007 | Bassetti |
| 2007/0057873 | A1 | 3/2007 | Uchino |
| 2007/0057874 | A1 | 3/2007 | Le Roy |
| 2007/0069998 | A1 | 3/2007 | Naugler |
| 2007/0075727 | A1 | 4/2007 | Nakano |
| 2007/0076226 | A1 | 4/2007 | Klompenhouwer |
| 2007/0080905 | A1 | 4/2007 | Takahara |
| 2007/0080906 | A1 | 4/2007 | Tanabe |
| 2007/0080908 | A1 | 4/2007 | Nathan |
| 2007/0097038 | A1 | 5/2007 | Yamazaki |
| 2007/0097041 | A1 | 5/2007 | Park |
| 2007/0103411 | A1 | 5/2007 | Cok et al. |
| 2007/0103419 | A1 | 5/2007 | Uchino |
| 2007/0115221 | A1 | 5/2007 | Buchhauser |
| 2007/0126672 | A1 | 6/2007 | Tada et al. |
| 2007/0164664 | A1 | 7/2007 | Ludwicki |
| 2007/0164938 | A1 | 7/2007 | Shin |
| 2007/0182671 | A1 | 8/2007 | Nathan |
| 2007/0236134 | A1 | 10/2007 | Ho |
| 2007/0236440 | A1 | 10/2007 | Wacyk |
| 2007/0236517 | A1 | 10/2007 | Kimpe |
| 2007/0241999 | A1 | 10/2007 | Lin |
| 2007/0273294 | A1 | 11/2007 | Nagayama |
| 2007/0285359 | A1 | 12/2007 | Ono |
| 2007/0290957 | A1 | 12/2007 | Cok |
| 2007/0290958 | A1 | 12/2007 | Cok |
| 2007/0296672 | A1 | 12/2007 | Kim |
| 2008/0001525 | A1 | 1/2008 | Chao |
| 2008/0001544 | A1 | 1/2008 | Murakami |
| 2008/0030518 | A1 | 2/2008 | Higgins |
| 2008/0036706 | A1 | 2/2008 | Kitazawa |
| 2008/0036708 | A1 | 2/2008 | Shirasaki |
| 2008/0042942 | A1 | 2/2008 | Takahashi |
| 2008/0042948 | A1 | 2/2008 | Yamashita |
| 2008/0048951 | A1 | 2/2008 | Naugler, Jr. |
| 2008/0055209 | A1 | 3/2008 | Cok |
| 2008/0055211 | A1 | 3/2008 | Ogawa |
| 2008/0074413 | A1 | 3/2008 | Ogura |

(56) References Cited

U.S. PATENT DOCUMENTS

| | | | |
|---|---|---|---|
| 2008/0088549 | A1 | 4/2008 | Nathan |
| 2008/0088648 | A1 | 4/2008 | Nathan |
| 2008/0111766 | A1 | 5/2008 | Uchino |
| 2008/0116787 | A1 | 5/2008 | Hsu |
| 2008/0117144 | A1 | 5/2008 | Nakano et al. |
| 2008/0136770 | A1 | 6/2008 | Peker et al. |
| 2008/0150845 | A1 | 6/2008 | Ishii |
| 2008/0150847 | A1 | 6/2008 | Kim |
| 2008/0158115 | A1 | 7/2008 | Cordes |
| 2008/0158648 | A1 | 7/2008 | Cummings |
| 2008/0191976 | A1 | 8/2008 | Nathan |
| 2008/0198103 | A1 | 8/2008 | Toyomura |
| 2008/0211749 | A1 | 9/2008 | Weitbruch |
| 2008/0231558 | A1 | 9/2008 | Naugler |
| 2008/0231562 | A1 | 9/2008 | Kwon |
| 2008/0231625 | A1 | 9/2008 | Minami |
| 2008/0246713 | A1 | 10/2008 | Lee |
| 2008/0252223 | A1 | 10/2008 | Toyoda |
| 2008/0252571 | A1 | 10/2008 | Hente |
| 2008/0259020 | A1 | 10/2008 | Fisekovic |
| 2008/0290805 | A1 | 11/2008 | Yamada |
| 2008/0297055 | A1 | 12/2008 | Miyake |
| 2009/0058772 | A1 | 3/2009 | Lee |
| 2009/0109142 | A1 | 4/2009 | Takahara |
| 2009/0121994 | A1 | 5/2009 | Miyata |
| 2009/0146926 | A1 | 6/2009 | Sung |
| 2009/0160743 | A1 | 6/2009 | Tomida |
| 2009/0174628 | A1 | 7/2009 | Wang |
| 2009/0184901 | A1 | 7/2009 | Kwon |
| 2009/0195483 | A1 | 8/2009 | Naugler, Jr. |
| 2009/0201281 | A1 | 8/2009 | Routley |
| 2009/0206764 | A1 | 8/2009 | Schemmann |
| 2009/0213046 | A1 | 8/2009 | Nam |
| 2009/0244046 | A1 | 10/2009 | Seto |
| 2009/0262047 | A1 | 10/2009 | Yamashita |
| 2010/0004891 | A1 | 1/2010 | Milers |
| 2010/0026725 | A1 | 2/2010 | Smith |
| 2010/0039422 | A1 | 2/2010 | Seto |
| 2010/0039458 | A1 | 2/2010 | Nathan |
| 2010/0060911 | A1 | 3/2010 | Marcu |
| 2010/0079419 | A1 | 4/2010 | Shibusawa |
| 2010/0085282 | A1 | 4/2010 | Yu |
| 2010/0103160 | A1 | 4/2010 | Jeon |
| 2010/0165002 | A1 | 7/2010 | Ahn |
| 2010/0194670 | A1 | 8/2010 | Cok |
| 2010/0207960 | A1 | 8/2010 | Kimpe |
| 2010/0225630 | A1 | 9/2010 | Levey |
| 2010/0251295 | A1 | 9/2010 | Amento |
| 2010/0277400 | A1 | 11/2010 | Jeong |
| 2010/0315319 | A1 | 12/2010 | Cok |
| 2011/0050870 | A1 | 3/2011 | Hanari |
| 2011/0063197 | A1 | 3/2011 | Chung |
| 2011/0069051 | A1 | 3/2011 | Nakamura |
| 2011/0069089 | A1 | 3/2011 | Kopf |
| 2011/0069096 | A1 | 3/2011 | Li |
| 2011/0074750 | A1 | 3/2011 | Leon |
| 2011/0149166 | A1 | 6/2011 | Botzas |
| 2011/0169798 | A1 | 7/2011 | Lee |
| 2011/0175895 | A1 | 7/2011 | Hayakawa |
| 2011/0181630 | A1 | 7/2011 | Smith |
| 2011/0199395 | A1 | 8/2011 | Nathan |
| 2011/0227964 | A1 | 9/2011 | Chaji |
| 2011/0242074 | A1 | 10/2011 | Bert et al. |
| 2011/0273399 | A1 | 11/2011 | Lee |
| 2011/0292006 | A1 | 12/2011 | Kim |
| 2011/0293480 | A1 | 12/2011 | Mueller |
| 2012/0056558 | A1 | 3/2012 | Toshiya |
| 2012/0062565 | A1 | 3/2012 | Fuchs |
| 2012/0262184 | A1 | 10/2012 | Shen |
| 2012/0299970 | A1 | 11/2012 | Bae |
| 2012/0299978 | A1 | 11/2012 | Chaji |
| 2013/0027381 | A1 | 1/2013 | Nathan |
| 2013/0057595 | A1 | 3/2013 | Nathan |
| 2013/0112960 | A1 | 5/2013 | Chaji |
| 2013/0135272 | A1 | 5/2013 | Park |
| 2013/0162617 | A1 | 6/2013 | Yoon |
| 2013/0201223 | A1 | 8/2013 | Li et al. |
| 2013/0309821 | A1 | 11/2013 | Yoo |
| 2013/0321671 | A1 | 12/2013 | Cote |
| 2014/0111567 | A1 | 4/2014 | Nathan et al. |

FOREIGN PATENT DOCUMENTS

| | | | |
|---|---|---|---|
| CA | 2 249 592 | | 7/1998 |
| CA | 2 368 386 | | 9/1999 |
| CA | 2 242 720 | | 1/2000 |
| CA | 2 354 018 | | 6/2000 |
| CA | 2 432 530 | | 7/2002 |
| CA | 2 436 451 | | 8/2002 |
| CA | 2 438 577 | | 8/2002 |
| CA | 2 463 653 | | 1/2004 |
| CA | 2 498 136 | | 3/2004 |
| CA | 2 522 396 | | 11/2004 |
| CA | 2 443 206 | | 3/2005 |
| CA | 2 472 671 | | 12/2005 |
| CA | 2 567 076 | | 1/2006 |
| CA | 2 526 782 | | 4/2006 |
| CA | 2 541 531 | | 7/2006 |
| CA | 2 550 102 | | 4/2008 |
| CA | 2 773 699 | | 10/2013 |
| CN | 1381032 | | 11/2002 |
| CN | 1448908 | | 10/2003 |
| CN | 1682267 | A | 10/2005 |
| CN | 1760945 | | 4/2006 |
| CN | 1886774 | | 12/2006 |
| CN | 101449311 | | 6/2009 |
| CN | 102656621 | | 9/2012 |
| EP | 0 158 366 | | 10/1985 |
| EP | 1 028 471 | | 8/2000 |
| EP | 1 111 577 | | 6/2001 |
| EP | 1 130 565 | A1 | 9/2001 |
| EP | 1 194 013 | | 4/2002 |
| EP | 1 335 430 | A1 | 8/2003 |
| EP | 1 372 136 | | 12/2003 |
| EP | 1 381 019 | | 1/2004 |
| EP | 1 418 566 | | 5/2004 |
| EP | 1 429 312 | A | 6/2004 |
| EP | 145 0341 | A | 8/2004 |
| EP | 1 465 143 | A | 10/2004 |
| EP | 1 469 448 | A | 10/2004 |
| EP | 1 521 203 | A2 | 4/2005 |
| EP | 1 594 347 | | 11/2005 |
| EP | 1 784 055 | A2 | 5/2007 |
| EP | 1854338 | A1 | 11/2007 |
| EP | 1 879 169 | A1 | 1/2008 |
| EP | 1 879 172 | | 1/2008 |
| EP | 2395499 | A1 | 12/2011 |
| GB | 2 389 951 | | 12/2003 |
| JP | 1272298 | | 10/1989 |
| JP | 4-042619 | | 2/1992 |
| JP | 6-314977 | | 11/1994 |
| JP | 8-340243 | | 12/1996 |
| JP | 09-090405 | | 4/1997 |
| JP | 10-254410 | | 9/1998 |
| JP | 11-202295 | | 7/1999 |
| JP | 11-219146 | | 8/1999 |
| JP | 11 231805 | | 8/1999 |
| JP | 11-282419 | | 10/1999 |
| JP | 2000-056847 | | 2/2000 |
| JP | 2000-81607 | | 3/2000 |
| JP | 2001-134217 | | 5/2001 |
| JP | 2001-195014 | | 7/2001 |
| JP | 2002-055654 | | 2/2002 |
| JP | 2002-91376 | | 3/2002 |
| JP | 2002-514320 | | 5/2002 |
| JP | 2002-278513 | | 9/2002 |
| JP | 2002-333862 | | 11/2002 |
| JP | 2003-076331 | | 3/2003 |
| JP | 2003-124519 | | 4/2003 |
| JP | 2003-177709 | | 6/2003 |
| JP | 2003-271095 | | 9/2003 |
| JP | 2003-308046 | | 10/2003 |
| JP | 2003-317944 | | 11/2003 |
| JP | 2004-004675 | | 1/2004 |

(56) References Cited

FOREIGN PATENT DOCUMENTS

| | | | |
|---|---|---|---|
| JP | 2004-145197 | | 5/2004 |
| JP | 2004-287345 | | 10/2004 |
| JP | 2005-057217 | | 3/2005 |
| JP | 2007-065015 | | 3/2007 |
| JP | 2008-102335 | | 5/2008 |
| JP | 4-158570 | | 10/2008 |
| KR | 2004-0100887 | | 12/2004 |
| TW | 342486 | | 10/1998 |
| TW | 473622 | | 1/2002 |
| TW | 485337 | | 5/2002 |
| TW | 502233 | | 9/2002 |
| TW | 538650 | | 6/2003 |
| TW | 1221268 | | 9/2004 |
| TW | 1223092 | | 11/2004 |
| TW | 200727247 | | 7/2007 |
| WO | WO 1998/48403 | | 10/1998 |
| WO | WO 1999/48079 | | 9/1999 |
| WO | WO 2001/06484 | | 1/2001 |
| WO | WO 2001/27910 | A1 | 4/2001 |
| WO | WO 2001/63587 | A2 | 8/2001 |
| WO | WO 2002/067327 | A | 8/2002 |
| WO | WO 2003/001496 | A1 | 1/2003 |
| WO | WO 2003/034389 | A | 4/2003 |
| WO | WO 2003/058594 | A1 | 7/2003 |
| WO | WO 2003/063124 | | 7/2003 |
| WO | WO 2003/077231 | | 9/2003 |
| WO | WO 2004/003877 | | 1/2004 |
| WO | WO 2004/025615 | A | 3/2004 |
| WO | WO 2004/034364 | | 4/2004 |
| WO | WO 2004/047058 | | 6/2004 |
| WO | WO 2004/104975 | A1 | 12/2004 |
| WO | WO 2005/022498 | | 3/2005 |
| WO | WO 2005/022500 | A | 3/2005 |
| WO | WO 2005/029455 | | 3/2005 |
| WO | WO 2005/029456 | | 3/2005 |
| WO | WO 2005/055185 | | 6/2005 |
| WO | WO 2006/000101 | A1 | 1/2006 |
| WO | WO 2006/053424 | | 5/2006 |
| WO | WO 2006/063448 | A | 6/2006 |
| WO | WO 2006/084360 | | 8/2006 |
| WO | WO 2007/003877 | A | 1/2007 |
| WO | WO 2007/079572 | | 7/2007 |
| WO | WO 2007/120849 | A2 | 10/2007 |
| WO | WO 2009/048618 | | 4/2009 |
| WO | WO 2009/055920 | | 5/2009 |
| WO | WO 2010/023270 | | 3/2010 |
| WO | WO 2010/146707 | A1 | 12/2010 |
| WO | WO 2011/041224 | A1 | 4/2011 |
| WO | WO 2011/064761 | A1 | 6/2011 |
| WO | WO 2011/067729 | | 6/2011 |
| WO | WO 2012/160424 | A1 | 11/2012 |
| WO | WO 2012/160471 | | 11/2012 |
| WO | WO 2012/164474 | A2 | 12/2012 |
| WO | WO 2012/164475 | A2 | 12/2012 |

OTHER PUBLICATIONS

Alexander : "Pixel circuits and drive schemes for glass and elastic AMOLED displays"; dated Jul. 2005 (9 pages).
Alexander : "Unique Electrical Measurement Technology for Compensation, Inspection, and Process Diagnostics of AMOLED HDTV"; dated May 2010 (4 pages).
Ashtiani : "AMOLED Pixel Circuit With Electronic Compensation of Luminance Degradation"; dated Mar. 2007 (4 pages).
Chaji : "A Current-Mode Comparator for Digital Calibration of Amorphous Silicon Amoled Displays"; dated Jul. 2008 (5 pages).
Chaji : "A fast settling current driver based on the CCII for AMOLED displays"; dated Dec. 2009 (6 pages).
Chaji : "A Low-Cost Stable Amorphous Silicon AMOLED Display with Full V~T- and V~O~L~E~D Shift Compensation"; dated May 2007 (4 pages).
Chaji : "A low-power driving scheme for a-Si:H active-matrix organic light-emitting diode displays"; dated Jun. 2005 (4 pages).
Chaji : "A low-power high-performance digital circuit for deep submicron technologies"; dated Jun. 2005 (4 pages).
Chaji : "A novel a-Si:H AMOLED pixel circuit based on short-term stress stability of a-Si:H TFTs"; dated Oct. 2005 (3 pages).
Chaji : "A Novel Driving Scheme and Pixel Circuit for AMOLED Displays"; dated Jun. 2006 (4 pages).
Chaji : "A Novel Driving Scheme for High Resolution Large-area a-Si:H AMOLED displays"; dated Aug. 2005 (3 pages).
Chaji : "A Stable Voltage-Programmed Pixel Circuit for a-Si:H AMOLED Displays"; dated Dec. 2006 (12 pages).
Chaji : "A Sub-μA fast-settling current-programmed pixel circuit for AMOLED displays"; dated Sep. 2007.
Chaji : "An Enhanced and Simplified Optical Feedback Pixel Circuit for AMOLED Displays"; dated Oct. 2006.
Chaji : "Compensation technique for DC and transient instability of thin film transistor circuits for large-area devices"; dated Aug. 2008.
Chaji : "Driving scheme for stable operation of 2-TFT a-Si AMOLED pixel"; dated Apr. 2005 (2 pages).
Chaji : "Dynamic-effect compensating technique for stable a-Si:H AMOLED displays"; dated Aug. 2005 (4 pages).
Chaji : "Electrical Compensation of OLED Luminance Degradation"; dated Dec. 2007 (3 pages).
Chaji : "eUTDSP: a design study of a new VLIW-based DSP architecture"; dated My 2003 (4 pages).
Chaji : "Fast and Offset-Leakage Insensitive Current-Mode Line Driver for Active Matrix Displays and Sensors"; dated Feb. 2009 (8 pages).
Chaji : "High Speed Low Power Adder Design With a New Logic Style: Pseudo Dynamic Logic (SDL)"; dated Oct. 2001 (4 pages).
Chaji : "High-precision, fast current source for large-area current-programmed a-Si flat panels"; dated Sep. 2006 (4 pages).
Chaji : "Low-Cost AMOLED Television with Ignis Compensating Technology"; dated May 2008 (4 pages).
Chaji : "Low-Cost Stable a-Si:H AMOLED Display for Portable Applications"; dated Jun. 2006 (4 pages).
Chaji : "Low-Power Low-Cost Voltage-Programmed a-Si:H AMOLED Display"; dated Jun. 2008 (5 pages).
Chaji : "Merged phototransistor pixel with enhanced near infrared response and flicker noise reduction for biomolecular imaging"; dated Nov. 2008 (3 pages).
Chaji : "Parallel Addressing Scheme for Voltage-Programmed Active-Matrix OLED Displays"; dated May 2007 (6 pages).
Chaji : "Pseudo dynamic logic (SDL): a high-speed and low-power dynamic logic family"; dated 2002 (4 pages).
Chaji : "Stable a-Si:H circuits based on short-term stress stability of amorphous silicon thin film transistors"; dated May 2006 (4 pages).
Chaji : "Stable Pixel Circuit for Small-Area High- Resolution a-Si:H AMOLED Displays"; dated Oct. 2008 (6 pages).
Chaji : "Stable RGBW AMOLED display with OLED degradation compensation using electrical feedback"; dated Feb. 2010 (2 pages).
Chaji : "Thin-Film Transistor Integration for Biomedical Imaging and AMOLED Displays"; dated 2008 (177 pages).
European Search Report for Application No. EP 04 78 6661 dated Mar. 9, 2009.
European Search Report for Application No. EP 05 75 9141 dated Oct. 30, 2009 (2 pages).
European Search Report for Application No. EP 05 81 9617 dated Jan. 30, 2009.
European Search Report for Application No. EP 06 70 5133 dated Jul. 18, 2008.
European Search Report for Application No. EP 06 72 1798 dated Nov. 12, 2009 (2 pages).
European Search Report for Application No. EP 07 71 0608.6 dated Mar. 19, 2010 (7 pages).
European Search Report for Application No. EP 07 71 9579 dated May 20, 2009.
European Search Report for Application No. EP 07 81 5784 dated Jul. 20, 2010 (2 pages).
European Search Report for Application No. EP 10 16 6143, dated Sep. 3, 2010 (2 pages).
European Search Report for Application No. EP 10 83 4294.0/1903, dated Apr. 8, 2013, (9 pages).

(56) References Cited

OTHER PUBLICATIONS

European Supplementary Search Report for Application No. EP 04 78 6662 dated Jan. 19, 2007 (2 pages).
Extended European Search Report for Application No. 11 73 9485.8 dated Aug. 6, 2013(14 pages).
Extended European Search Report for Application No. EP 09 73 3076.5, dated Apr. 27, (13 pages).
Extended European Search Report for Application No. EP 11 16 8677.0, dated Nov. 29, 2012, (13 page).
Extended European Search Report for Application No. EP 11 19 1641.7 dated Jul. 11, 2012 (14 pages).
Extended European Search Report for Application No. EP 10834297 dated Oct. 27, 2014 (6 pages).
Fossum, Eric R.. "Active Pixel Sensors: Are CCD's Dinosaurs?" SPIE: Symposium on Electronic Imaging. Feb. 1, 1993 (13 pages).
Goh , "A New a-Si:H Thin-Film Transistor Pixel Circuit for Active-Matrix Organic Light-Emitting Diodes", IEEE Electron Device Letters, vol. 24, No. 9, Sep. 2003, pp. 583-585.
International Preliminary Report on Patentability for Application No. PCT/CA2005/001007 dated Oct. 16, 2006, 4 pages.
International Search Report for Application No. PCT/CA2004/001741 dated Feb. 21, 2005.
International Search Report for Application No. PCT/CA2004/001742, Canadian Patent Office, dated Feb. 21, 2005 (2 pages).
International Search Report for Application No. PCT/CA2005/001007 dated Oct. 18, 2005.
International Search Report for Application No. PCT/CA2005/001897, dated Mar. 21, 2006 (2 pages).
International Search Report for Application No. PCT/CA2007/000652 dated Jul. 25, 2007.
International Search Report for Application No. PCT/CA2009/000501, dated Jul. 30, 2009 (4 pages).
International Search Report for Application No. PCT/CA2009/001769, dated Apr. 8, 2010 (3 pages).
International Search Report for Application No. PCT/IB2010/055481, dated Apr. 7, 2011, 3 pages.
International Search Report for Application No. PCT/IB2010/055486, dated Apr. 19, 2011, 5 pages.
International Search Report for Application No. PCT/IB2014/060959, dated Aug. 28, 2014, 5 pages.
International Search Report for Application No. PCT/IB2010/055541 filed Dec. 1, 2010, dated May 26, 2011; 5 pages.
International Search Report for Application No. PCT/IB2011/050502, dated Jun. 27, 2011 (6 pages).
International Search Report for Application No. PCT/IB2011/051103, dated Jul. 8, 2011, 3 pages.
International Search Report for Application No. PCT/IB2011/055135, Canadian Patent Office, dated Apr. 16, 2012 (5 pages).
International Search Report for Application No. PCT/IB2012/052372, dated Sep. 12, 2012 (3 pages).
International Search Report for Application No. PCT/IB2013/054251, Canadian Intellectual Property Office, dated Sep. 11, 2013; (4 pages).
International Search Report for Application No. PCT/JP02/09668, dated Dec. 3, 2002, (4 pages).
International Written Opinion for Application No. PCT/CA2004/001742, Canadian Patent Office, dated Feb. 21, 2005 (5 pages).
International Written Opinion for Application No. PCT/CA2005/001897, dated Mar. 21, 2006 (4 pages).
International Written Opinion for Application No. PCT/CA2009/000501 dated Jul. 30, 2009 (6 pages).
International Written Opinion for Application No. PCT/IB2010/055481, dated Apr. 7, 2011, 6 pages.
International Written Opinion for Application No. PCT/IB2010/055486, dated Apr. 19, 2011, 8 pages.
International Written Opinion for Application No. PCT/IB2010/055541, dated May 26, 2011; 6 pages.
International Written Opinion for Application No. PCT/IB2011/050502, dated Jun. 27, 2011 (7 pages).
International Written Opinion for Application No. PCT/IB2011/051103, dated Jul. 8, 2011, 6 pages.
International Written Opinion for Application No. PCT/IB2011/055135, Canadian Patent Office, dated Apr. 16, 2012 (5 pages).
International Written Opinion for Application No. PCT/IB2012/052372, dated Sep. 12, 2012 (6 pages).
International Written Opinion for Application No. PCT/IB2013/054251, Canadian Intellectual Property Office, dated Sep. 11, 2013; (5 pages).
Jafarabadiashtiani : "A New Driving Method for a-Si AMOLED Displays Based on Voltage Feedback"; dated 2005 (4 pages).
Kanicki, J., "Amorphous Silicon Thin-Film Transistors Based Active-Matrix Organic Light-Emitting Displays." Asia Display: International Display Workshops, Sep. 2001 (pp. 315-318).
Karim, K. S., "Amorphous Silicon Active Pixel Sensor Readout Circuit for Digital Imaging." IEEE: Transactions on Electron Devices. vol. 50, No. 1, Jan. 2003 (pp. 200-208).
Lee : "Ambipolar Thin-Film Transistors Fabricated by PECVD Nanocrystalline Silicon"; dated 2006.
Lee, Wonbok: "Thermal Management in Microprocessor Chips and Dynamic Backlight Control in Liquid Crystal Displays", Ph.D. Dissertation, University of Southern California (124 pages).
Liu, P. et al., Innovative Voltage Driving Pixel Circuit Using Organic Thin-Film Transistor for AMOLEDs, Journal of Display Technology, vol. 5, Issue 6, Jun. 2009 (pp. 224-227).
Ma E Y: "organic light emitting diode/thin film transistor integration for foldable displays" dated Sep. 15, 1997(4 pages).
Matsueda y : "35.1: 2.5-in. AMOLED with Integrated 6-bit Gamma Compensated Digital Data Driver"; dated May 2004.
Mendes E., "A High Resolution Switch-Current Memory Base Cell." IEEE: Circuits and Systems. vol. 2, Aug. 1999 (pp. 718-721).
Nathan A. , "Thin Film imaging technology on glass and plastic" ICM 2000, proceedings of the 12 international conference on microelectronics, dated Oct. 31, 2001 (4 pages).
Nathan , "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Nathan : "Backplane Requirements for active Matrix Organic Light Emitting Diode Displays,"; dated 2006 (16 pages).
Nathan : "Call for papers second international workshop on compact thin-film transistor (TFT) modeling for circuit simulation"; dated Sep. 2009 (1 page).
Nathan : "Driving schemes for a-Si and LTPS AMOLED displays"; dated Dec. 2005 (11 pages).
Nathan : "Invited Paper: a-Si for AMOLED—Meeting the Performance and Cost Demands of Display Applications (Cell Phone to HDTV)"; dated 2006 (4 pages).
Office Action in Japanese patent application No. JP2012-541612 dated Jul. 15, 2014. (3 pages).
Partial European Search Report for Application No. EP 11 168 677.0, dated Sep. 22, 2011 (5 pages).
Partial European Search Report for Application No. EP 11 19 1641.7, dated Mar. 20, 2012 (8 pages).
Philipp: "Charge transfer sensing" Sensor Review, vol. 19, No. 2, Dec. 31, 1999 (Dec. 31, 1999), 10 pages.
Rafati : "Comparison of a 17 b multiplier in Dual-rail domino and in Dual-rail D L (D L) logic styles"; dated 2002 (4 pages).
Safavian : "3-TFT active pixel sensor with correlated double sampling readout circuit for real-time medical x-ray imaging"; dated Jun. 2006 (4 pages).
Safavian : "A novel current scaling active pixel sensor with correlated double sampling readout circuit for real time medical x-ray imaging"; dated May 2007 (7 pages).
Safavian : "A novel hybrid active-passive pixel with correlated double sampling CMOS readout circuit for medical x-ray imaging"; dated May 2008 (4 pages).
Safavian : "Self-compensated a-Si:H detector with current-mode readout circuit for digital X-ray fluoroscopy"; dated Aug. 2005 (4 pages).
Safavian : "TFT active image sensor with current-mode readout circuit for digital x-ray fluoroscopy [5969D-82]"; dated Sep. 2005 (9 pages).

(56) References Cited

OTHER PUBLICATIONS

Safavian : "Three-TFT image sensor for real-time digital X-ray imaging"; dated Feb. 2, 2006 (2 pages).
Singh "Current Conveyor: Novel Universal Active Block", Samriddhi, S-JPSET vol. I, Issue 1, 2010, pp. 41-48 (12EPPT).
Smith, Lindsay I., "A tutorial on Principal Components Analysis," dated Feb. 26, 2001 (27 pages).
Spindler , System Considerations for RGBW OLED Displays, Journal of the SID 14/1, 2006, pp. 37-48.
Stewart M. , "polysilicon TFT technology for active matrix oled displays" IEEE transactions on electron devices, vol. 48, No. 5, dated May 2001 (7 pages).
Vygranenko : "Stability of indium-oxide thin-film transistors by reactive ion beam assisted deposition"; dated 2009
Wang : "Indium oxides by reactive ion beam assisted evaporation: From material study to device application"; dated Mar. 2009 (6 pages).
Yi He , "Current-Source a-Si:H Thin Film Transistor Circuit for Active-Matrix Organic Light-Emitting Displays", IEEE Electron Device Letters, vol. 21, No. 12, Dec. 2000, pp. 590-592.
Yu, Jennifer: "Improve OLED Technology for Display", Ph.D. Dissertation, Massachusetts Institute of Technology, Sep. 2008 (151 pages).
International Search Report for Application No. PCT/IB2014/058244, Canadian Intellectual Property Office, dated Apr. 11, 2014; (6 pages).
International Search Report for Application No. PCT/IB2014/059753, Canadian Intellectual Property Office, dated Jun. 23, 2014; (6 pages).
Written Opinion for Application No. PCT/IB2014/059753, Canadian Intellectual Property Office, dated Jun. 12, 2014 (6 pages).
International Search Report for Application No. PCT/IB2014/060879, Canadian Intellectual Property Office, dated Jul. 17, 2014 (3 pages).
Extended European Search Report for Application No. EP 14158051.4, dated Jul. 29, 2014, (4 pages).
Office Action in Chinese Patent Invention No. 201180008188.9, dated Jun. 4, 2014 (17 pages) (W/English translation).
International Search Report for Application No. PCT/IB/2014/066932 dated Mar. 24, 2015.
Written Opinion for Application No. PCT/IB/2014/066932 dated Mar. 24, 2015.
Extended European Search Report for Application No. EP 11866291.5, dated Mar. 9, 2015, (9 pages).
Extended European Search Report for Application No. EP 14181848.4, dated Mar. 5, 2015, (8 pages).
Office Action in Chinese Patent Invention No. 201280022957.5, dated Jun. 26, 2015 (7 pages).

ADAPTIVE FEEDBACK SYSTEM FOR COMPENSATING FOR AGING PIXEL AREAS WITH ENHANCED ESTIMATION SPEED

CROSS REFERENCE TO RELATED APPLICATION

This application is a continuation of U.S. patent application Ser. No. 15/262,266, filed Sep. 12, 2016, now allowed, which is a continuation of U.S. patent application Ser. No. 13/291,486, filed Nov. 8, 2011, now U.S. Pat. No. 9,466,240, which claims the benefit of U.S. Provisional Application No. 61/490,309, filed May 26, 2011, entitled "Adaptive Feedback System For Compensating For Aging Pixel Areas With Enhanced Estimation Speed," the entire contents of which are hereby incorporated herein by reference.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

BACKGROUND

An existing system provides an electrical feedback to compensate for aging by the drive transistors and by the organic light emitting devices (OLEDs) in the pixels of a display panel. The display panel can broken into several blocks. In each frame, the electrical aging of a very small number of pixels can be measured by each block. Thus, a full-panel scan is a very lengthy process, causing problems in the presence of fast-aging phenomena and thermal effects.

For example, assuming a panel size of 600×800 pixels or 1200×1600 sub-pixels, if a control circuit controls 210 columns, eight of such circuits are needed. Suppose the frame rate is 60 Hz, and 10 sub-pixels in each of the eight circuits are measured in each frame simultaneously, a full-panel scan period is: 1200*210/10/60/60 or 7 minutes. As a result, the compensation of an aged/relaxed area with an absolute value difference of 100 from the initial estimation, takes at least 100*7=700 minutes or over 11 hours, an unacceptably excessive amount of time. A more efficient compensation scheme is needed.

BRIEF SUMMARY

An algorithm is disclosed that increases the efficiency of the process by which variations or fast changes in the pixels is compensated (such as caused by a phenomenon that adversely affects the pixels such as aging, relaxation, color shift, temperature changes, or process non-uniformities), by adaptively directing measurements toward areas with high a probability of a change (such as aging/relaxation) from a previously measured value (due to aging, relaxation, temperature change, process non-uniformities, etc.) or a deviation from a reference value (due to a mismatch in the drive current, $V_{OLED}$, brightness, color intensity, and the like), increasing the estimation speed in such areas, and providing a process to update the estimated changing (e.g., aging) of pixels that are not being measured using other pixels' measurements.

According to an aspect of the present disclosure, a method of discriminating areas that are deviating from a previous state or from a previously measured reference value is disclosed. The areas are areas of a display panel of pixels organized into clusters of pixels. The method includes scanning each of at least one of the pixels in a first cluster until a first criterion is satisfied. The scanning includes: measuring a characteristic of a target one of the pixels in the first cluster; comparing the measured characteristic with a reference characteristic to determine a state of the target pixel; and if the state of the target pixel has changed relative to a prior measurement of the target pixel, determining that the first criterion is satisfied. The method further includes, responsive to the first criterion being satisfied, automatically compensating for deviations of the measured characteristic of the display panel based at least on the state of the scanned pixels to shift the measured characteristic toward the reference characteristic.

The pixels of the display can be further organized into a plurality of regions. Each of at least some of the regions can have a plurality of clusters of pixels. The scanning can be carried out in at least one cluster in each of the regions, The first criterion can be satisfied responsive to the state of at least one of the pixels in each of the regions changing relative to a prior measurement of the at least one pixel. The state can indicate at least whether the target pixel is in an aging state indicating that the target pixel is aging. The automatically compensating can compensate for an aging or an overcompensation of at least one of the pixels in the first cluster.

The measured characteristic can be a current used to drive a light emitting device in the target pixel. The scanning can be carried out according to a scan order starting at a top-right pixel and ending at a bottom-left pixel in the first cluster. The measuring can be carried out on only some of the pixels in the first cluster prior to carrying out the automatically compensating.

The method can further include prioritizing the first cluster as a function of the respective states of each of the measured pixels in the first cluster to produce a priority value. The state can further indicate whether the target pixel is in an overcompensated state. The function can include determining an absolute difference of the number of measured pixels in the first cluster that are in the overcompensated state versus the number of measured pixels in the first cluster that are in an aging state.

The method can further include determining a number of additional pixels to be measured in the first cluster based on the priority value such that a higher priority value indicates more additional pixels to be measured in the first cluster; and measuring a characteristic of each of the additional pixels to determine the state of each of the additional pixels. The state can further indicate whether the target pixel is in an overcompensated state. The function can include determining an absolute difference of the number of measured pixels in the first cluster that are in the overcompensated state versus the number of measured pixels in the first cluster that are in an aging state. The number of additional pixels can be zero responsive to the absolute difference not exceeding a minimum threshold indicative of whether additional pixels are to be measured in the first cluster.

Responsive to the priority value exceeding a threshold, the method can further include adjusting a corresponding absolute aging value associated with those of neighboring pixels to the measured pixel that share the same state as the measured pixel. The absolute aging value can be indicative of an extent to which the measured pixel is aged or overcompensated.

The method can further include reducing, for each of the neighboring pixels whose absolute aging value has been adjusted, a coefficient of an average filter associated with each of the neighboring pixels whose absolute aging value has been adjusted. The adjusting can include incrementing by one the absolute aging value responsive to the state of the measured pixel being in the aging state and decrementing by one the absolute aging value responsive to the state of the measured pixel being in the overcompensated state.

The absolute aging value can be adjusted by a constant value or as a function of the priority value such that the absolute aging value is adjusted by a larger amount for higher priority values relative to lower priority values. The method can further include prioritizing the at least one cluster in each of the regions as a function of the respective states of each of the measured pixels in the corresponding ones of the measured clusters to produce for each of the regions a corresponding priority value. The state can include whether the target pixel is in an overcompensated state. The function can include determining an absolute difference of the number of measured pixels in each of the at least one cluster in each of the regions that are in the overcompensated state versus the number of measured pixels in each of the at least one cluster in each of the regions that are in an aging state. The absolute difference can correspond to the priority value. For each of the regions, the method can further determine a number of additional pixels to be measured in the corresponding at least one cluster based on the priority value such that a higher priority value indicates more additional pixels to be measured in the corresponding at least one cluster.

The target pixel in the first cluster can be on a first row in the first cluster. The scanning can further include, during a frame, measuring a characteristic of a second target one of the pixels in the first cluster. The second target pixel can be present on a second row distinct from the first row in the first cluster. Each of the additional pixels can be on different consecutive or non-consecutive rows within the first cluster. The measuring the characteristic of each of the additional pixels can be carried out on at least two of the additional pixels on the different rows during a frame.

The state can further indicate whether the target pixel is in an aging or overcompensated state. The measured characteristic can be a current drawn by a light emitting device in the target pixel and the reference characteristic is a reference current. The reference current can be a current drawn by a reference pixel in the display panel.

According to another aspect of the present disclosure, a method of prioritizing areas of high probability of deviations from a previously measured value or a reference value of a characteristic of areas of pixels of a display panel of pixels, includes: measuring a characteristic of at least some of the pixels of the display panel; comparing the measured characteristic for each of the measured pixels with a corresponding reference characteristic to determine a corresponding state of each of the measured pixels; prioritizing the areas of the display panel as a function of the state of the measured pixels in each of the areas to produce a priority order; and automatically compensating for a deviation by the measured characteristic from the reference characteristic in the areas according to the priority order.

The method can further include scanning each of the at least some of the pixels in a first cluster until a first criterion is satisfied. The scanning can further include: comparing the measured characteristic with a reference characteristic to determine a state of a target pixel in the first cluster, the state indicating at least whether the target pixel is in an aging state indicating that the target pixel is aging; and if the state of the target pixel has changed relative to a prior measurement of the target pixel, determining that the first criterion is satisfied. The automatically compensating can be based at least on the state of the scanned pixels and compensates for an aging or an overcompensation of the areas.

The pixels of the display can be further organized into a plurality of regions. Each of at least some of the regions can have a plurality of clusters of pixels. The scanning can be carried out in at least one cluster in each of the regions. The first criterion can be satisfied responsive to the state of at least one of the pixels in each of the regions changing relative to a prior measurement of the at least one pixel.

The measured characteristic can be a current used to drive a light emitting device in the target pixel and the reference characteristic is a reference current. The scanning can be carried out according to a scan order starting at a top-right pixel and ending at a bottom-left pixel in the first cluster.

The state can indicate whether the target pixel is in an aging or an overcompensated state. The function can include determining an absolute difference of the number of measured pixels in the first cluster that are in the overcompensated state versus the number of measured pixels in the first cluster that are in the aging state.

The prioritizing can include prioritizing the first cluster as a function of the respective states of each of the measured pixels in the first cluster to produce a priority value. The method can further include: determining a number of additional pixels to be measured in the first cluster based on the priority value such that a higher priority value indicates more additional pixels to be measured in the first cluster; and measuring a characteristic of each of the additional pixels to determine the state of each of the additional pixels.

The state can indicate whether the target pixel is in an aging or an overcompensated state. The function can include determining an absolute difference of the number of measured pixels in the first cluster that are in the overcompensated state versus the number of measured pixels in the first cluster that are in the aging state. The number of additional pixels can be zero responsive to the absolute difference not exceeding a minimum threshold indicative of whether additional pixels are to be measured in the first cluster.

The state can indicate whether the target pixel is in an aging or an overcompensated state. The method can further include: responsive to the priority value exceeding a threshold, adjusting a corresponding absolute aging value associated with those of neighboring pixels to the measured pixel that share the same state as the measured pixel, the absolute aging value corresponding to a value indicating an extent to which a pixel is aging or overcompensated. The method can further include reducing, for each of the neighboring pixels whose absolute aging value has been adjusted, a coefficient of an average filter associated with each of the neighboring pixels whose absolute aging value has been adjusted.

The adjusting can include incrementing by one the absolute aging value responsive to the state of the measured pixel being in the aging state and decrementing by one the absolute aging value responsive to the state of the measured pixel being in the overcompensated state. The absolute aging value can be adjusted by a constant value or as a function of the priority value such that the absolute aging value is adjusted by a larger amount for higher priority values relative to lower priority values.

According to still another aspect of the present disclosure, a method is disclosed of updating an estimated aging of neighboring pixels of a display panel using a known measurement of a pixel. The display panel is organized into clusters of pixels. The method includes: measuring a characteristic of each pixel in a first cluster of the clusters of the display panel; for each pixel in the cluster, comparing the measured characteristic of the pixel with a reference characteristic to determine a state of the pixel, the state indicating whether the pixel is in an aging state, an overcompensated state, or neither; if the state of a selected pixel in the cluster is unchanged relative to a prior measurement of the selected pixel and the state of the selected pixel is the same as the state of the majority of other pixels in the cluster, adjusting corresponding aging values associated with neighboring pixels to the selected pixel, each of the aging values representing an aging or a relaxation state of a pixel and stored in a memory coupled to the display panel; and automatically compensating for an aging or relaxation of the display panel based at least in part on the aging values of the neighboring pixels.

The method can further include reducing, for each of the neighboring pixels whose aging value has been adjusted, a coefficient of an average filter associated with each of the neighboring pixels whose aging value has been adjusted. The neighboring pixels can be immediately adjacent to the selected pixel.

According to yet another aspect of the present disclosure, a method of selectively scanning areas of a display panel having pixels and divided into a plurality of clusters of pixels, includes scanning at least some of the clusters in a first phase until a first criterion is satisfied. The scanning includes: measuring a characteristic of a target pixel in the cluster being scanned according to a pixel scanning order; comparing the measured characteristic with a reference characteristic to produce a state of the target pixel, the state indicating whether the target pixel is in an aging state, a relaxation state, or neither; responsive to the state for the target pixel differing from a previous state for the target pixel, determining that the first criterion is satisfied; and responsive to a predetermined number of target pixels in the cluster being scanned, determining that the first criterion is satisfied. Responsive to the first criterion being satisfied, the method further scans at least one of the clusters. The further scanning includes: determining a priority for scanning additional pixels as a function of the extent of aging or relaxation of the cluster being scanned; measuring the characteristic of a number of additional target pixels in the cluster being scanned, wherein the number of additional target pixels is a function of the priority; and adjusting corresponding aging values associated with neighboring pixels to the target pixel, each of the aging values representing an aging or a relaxation state of a pixel and stored in a memory, responsive to the state of the target pixel being the same as the state of a majority of the other pixels in the cluster being scanned.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

Figure 1A:
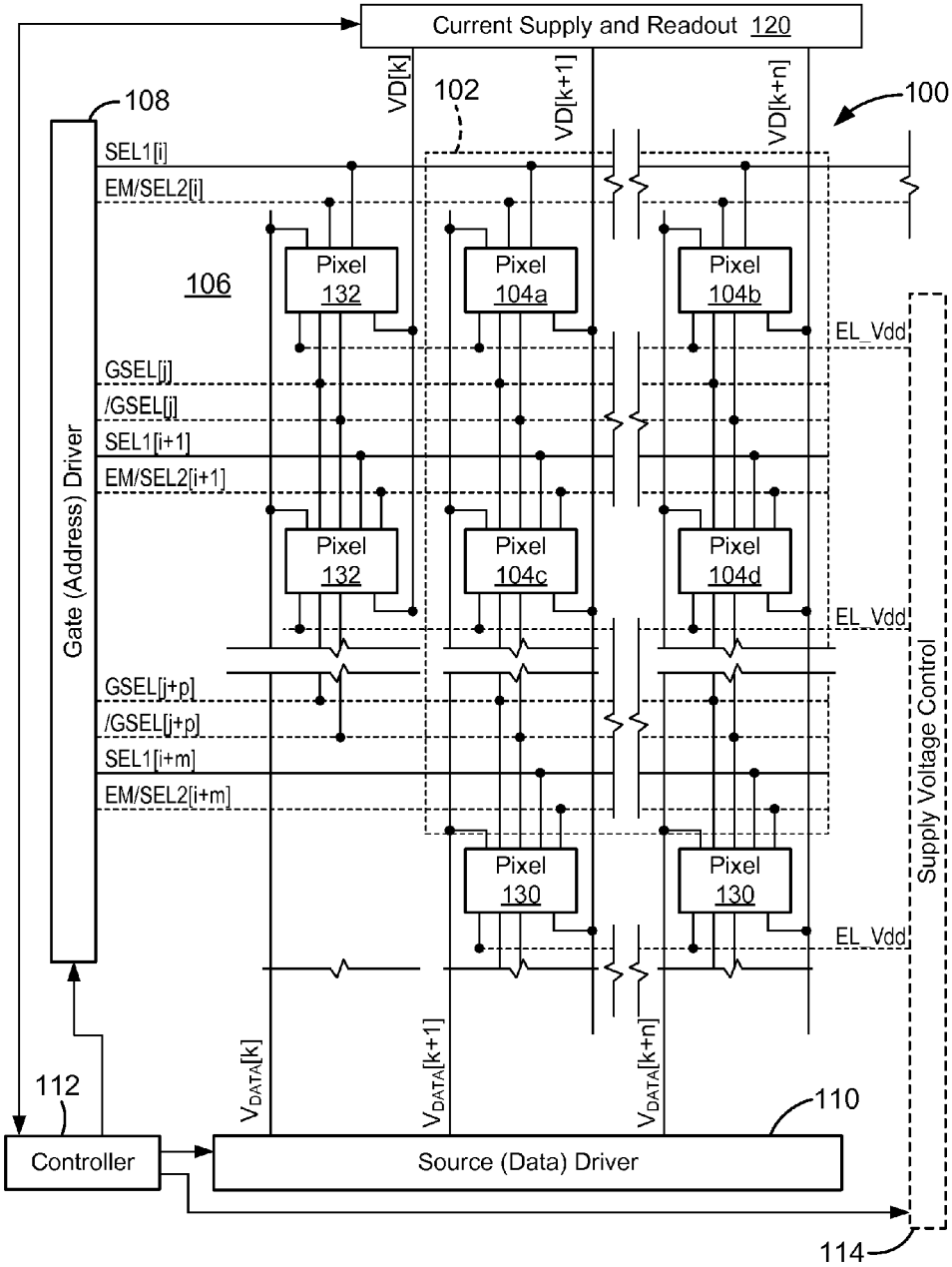
FIG. 1A illustrates an electronic display system or panel having an active matrix area or pixel array in which an array of pixels are arranged in a row and column configuration.

While the present disclosure is susceptible to various modifications and alternative forms, specific embodiments and implementations have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the invention as defined by the appended claims.

DETAILED DESCRIPTION

It should be noted that the present disclosure is directed to identifying areas of a pixel array for compensation for changes in a characteristic of the pixels, such as caused by a phenomenon such as aging or relaxation, temperature change, or process non-uniformities. Changes in the characteristic due to the adverse phenomenon can be measured by an appropriate measurement circuit or algorithm and tracked by any reference value, such as reference values indicating that a pixel (specifically, a drive transistor of the pixel) is aging or relaxing, or reference values indicative of the brightness performance or color shift of the pixel or a current deviation from an expected drive current value required to achieve a desired brightness. How those areas of pixels, once identified, are compensated (such as for aging or relaxation) is not the focus of the present disclosure. Exemplary disclosures for compensating for aging or relaxation of the pixels in a display are known. Examples can be found in commonly assigned, co-pending U.S. patent application Ser. No. 12/956,842, entitled "System and Methods For Aging Compensation in AMOLED Displays," filed on Nov. 30, 2010, and in commonly assigned, co-pending U.S. patent application Ser. No. 13/020,252, entitled "System and Methods For Extracting Correlation Curves For an Organic Light Emitting Device," filed Feb. 3, 2011. The present disclosure pertains to both compensating for the phenomena of aging and relaxation of pixels (either the light emitting device or the drive TFT transistor that drives current to the light emitting device) in a display (but not both simultaneously, as a pixel is either in a state of aging, relaxation, or neither aging nor relaxation—i.e., in a normal "healthy" state), temperature variation, non-uniformity caused by process variation, as those terms are understood by those of ordinary skill in the art to which the present disclosure pertains, and generally to compensating for any change in a measurable characteristic of the pixel circuits caused by any such phenomena, such as a drive current applied to a light emitting device of the pixels, brightness of the light emitting device (e.g., brightness output can be conventionally measured by a photosensor or other sensor circuit), color shift of the light emitting device, or a shift in the voltage associated with an electronic device in the pixel circuit, such as $V_{OLED}$, which corresponds to the voltage across a light emitting device in the pixel. In this disclosure, while occasionally the conjunctive "aging/relaxation" or "aged/relaxed" or the like phrases will be used, it should be understood that any discussion relating to aging pertains equally to relaxation, and vice versa, and other phenomena that causes divergence from a reference state of a measurable characteristic of a pixel or a pixel circuit. Instead of relaxation, the terms "recovering," recovering," "relaxing," or "overcompensated" may be used, and these terms are interchangeable and mutually synonymous as used herein. To avoid the awkward recitation of "aging/relaxation" throughout the present disclosure, this disclosure may occasionally refer to aging or relaxation only, but it should be understood that the concepts and aspects disclosed herein apply with equal force to both phenomena. The various grammatical variants of the verbs age or relax, such as aging, aged, relaxed, relaxing, or relaxation, are used interchangeably herein. The examples herein assume that the phenomena being compensated for is aging or relaxation of a drive transistor of a pixel, but it should be emphasized that the present disclosure is not limited to fast compensating for the phenomena of aging or relaxation only, but rather is equally applicable to compensating for any changing phenomena of the pixels or their associated pixel circuits by measuring a characteristic of the pixel/pixel circuit and comparing the measured characteristic against a previously measured value or a reference value to determine whether the pixel/pixel circuit is being afflicted by the phenomenon (e.g., aging, overcompensation, color shift, temperature or process variation, or deviation in the drive current or $V_{OLED}$ relative to a reference current or voltage).

For convenience, the systems and methods for identifying areas of change (such as aging or relaxation) will be referred to merely as an estimation algorithm. The estimation algorithm adaptively directs the measurements of pixels in those areas that have a high probability of change (e.g., aging/relaxation), resulting in a fast estimation speed for compensation, as discussed below in connection with the drawings. Newly changed (e.g., aged or relaxed) areas of a display panel can be discriminated quickly by the estimation algorithm without requiring a full panel scan of all the pixels. By change, it is meant a change of a characteristic of the pixel or its associated pixel circuit. The characteristic, as explained above, can be a drive TFT current, $V_{OLED}$, a pixel brightness, or a color intensity, for example. These changes can occur as a result of one or more phenomena including aging or over-compensation of a pixel, environmental temperature variations, or due to non-uniformities in the materials inherent in the semiconductor manufacturing process that cause performance variations among the pixels or clusters of pixels on a substrate.

FIG. 1A is an electronic display system 100 having an active matrix area or pixel array 102 in which an array of active pixels 104*a-d* are arranged in a row and column configuration. For ease of illustration, only two rows and columns are shown. External to the active matrix area which is the pixel array 102 is a peripheral area 106 where peripheral circuitry for driving and controlling the area of the pixel array 102 are disposed. The peripheral circuitry includes a gate or address driver circuit 108, a source or data driver circuit 110, a controller 112, and an optional supply voltage (e.g., Vdd) driver 114. The controller 112 controls the gate, source, and supply voltage drivers 108, 110, 114. The gate driver 108, under control of the controller 112, operates on address or select lines SEL[i], SEL[i+1], and so forth, one for each row of pixels 104 in the pixel array 102. In pixel sharing configurations, the gate or address driver circuit 108 can also optionally operate on global select lines GSEL[j] and optionally/GSEL[j], which operate on multiple rows of pixels 104*a-d* in the pixel array 102, such as every two rows of pixels 104*a-d*. The source driver circuit 110, under control of the controller 112, operates on voltage data lines Vdata[k], Vdata[k+1], and so forth, one for each column of pixels 104*a-d* in the pixel array 102. The voltage data lines carry voltage programming information to each pixel 104 indicative of brightness of each light emitting device or element in the pixel 104. A storage element, such as a capacitor, in each pixel 104 stores the voltage programming information until an emission or driving cycle turns on the light emitting device. The optional supply voltage driver 114, under control of the controller 112, controls a supply voltage (EL_Vdd) line, one for each row of pixels 104*a-d* in the pixel array 102.

The display system 100 can also include a current source circuit, which supplies a fixed current on current bias lines. In some configurations, a reference current can be supplied to the current source circuit. In such configurations, a current source control controls the timing of the application of a bias current on the current bias lines. In configurations in which the reference current is not supplied to the current source circuit, a current source address driver controls the timing of the application of a bias current on the current bias lines.

As is known, each pixel 104*a-d* in the display system 100 needs to be programmed with information indicating the brightness of the light emitting device in the pixel 104*a-d*. A frame defines the time period that includes a programming cycle or phase during which each and every pixel in the display system 100 is programmed with a programming voltage indicative of a brightness and a driving or emission cycle or phase during which each light emitting device in each pixel is turned on to emit light at a brightness commensurate with the programming voltage stored in a storage element. A frame is thus one of many still images that compose a complete moving picture displayed on the display system 100. There are at least two schemes for programming and driving the pixels: row-by-row, or frame-by-frame. In row-by-row programming, a row of pixels is programmed and then driven before the next row of pixels is programmed and driven. In frame-by-frame programming, all rows of pixels in the display system 100 are programmed first, and all of the frames are driven row-by-row. Either scheme can employ a brief vertical blanking time at the beginning or end of each frame during which the pixels are neither programmed nor driven.

The components located outside of the pixel array 102 can be disposed in a peripheral area 106 around the pixel array 102 on the same physical substrate on which the pixel array 102 is disposed. These components include the gate driver 108, the source driver 110 and the optional supply voltage control 114. Alternately, some of the components in the peripheral area can be disposed on the same substrate as the pixel array 102 while other components are disposed on a different substrate, or all of the components in the peripheral area can be disposed on a substrate different from the substrate on which the pixel array 102 is disposed. Together, the gate driver 108, the source driver 110, and the supply voltage control 114 make up a display driver circuit. The display driver circuit in some configurations may include the gate driver 108 and the source driver 110 but not the supply voltage control 114.

The display system 100 further includes a current supply and readout circuit 120, which reads output data from data output lines, VD[k], VD[k+1], and so forth, one for each column of pixels 104*a*, 104*c* in the pixel array 102. A set of column reference pixels 130 is fabricated on the edge of the pixel array 102 at the end of each column such as the column of pixels 104*a* and 104*c*. The column reference pixels 130 can also receive input signals from the controller 112 and output corresponding current or voltage signals to the current supply and readout circuit 120. Each of the column reference pixels 130 includes a reference drive transistor and a reference light emitting device, such as an OLED, but the reference pixels are not part of the pixel array 102 that displays images. The column reference pixels 130 are not driven for most of the programming cycle because they are not part of the pixel array 102 to display images and therefore do not age from the constant application of programming voltages as compared to the pixels 104*a* and 104*c*. Although only one column reference pixel 130 is shown in FIG. 1, it is to be understood that there can be any number of column reference pixels although two to five such reference pixels can be used for each column of pixels in this example. Correspondingly, each row of pixels in the array 102 also includes row reference pixels 132 at the ends of each row of pixels, such as the pixels 104*a* and 104*b*. Each of the row reference pixels 132 includes a reference drive transistor and a reference light emitting device but are not part of the pixel array 102 that displays images. The row reference pixels 132 provide a reference check for luminance curves for the pixels that were determined at the time of production.

Figure 1B:
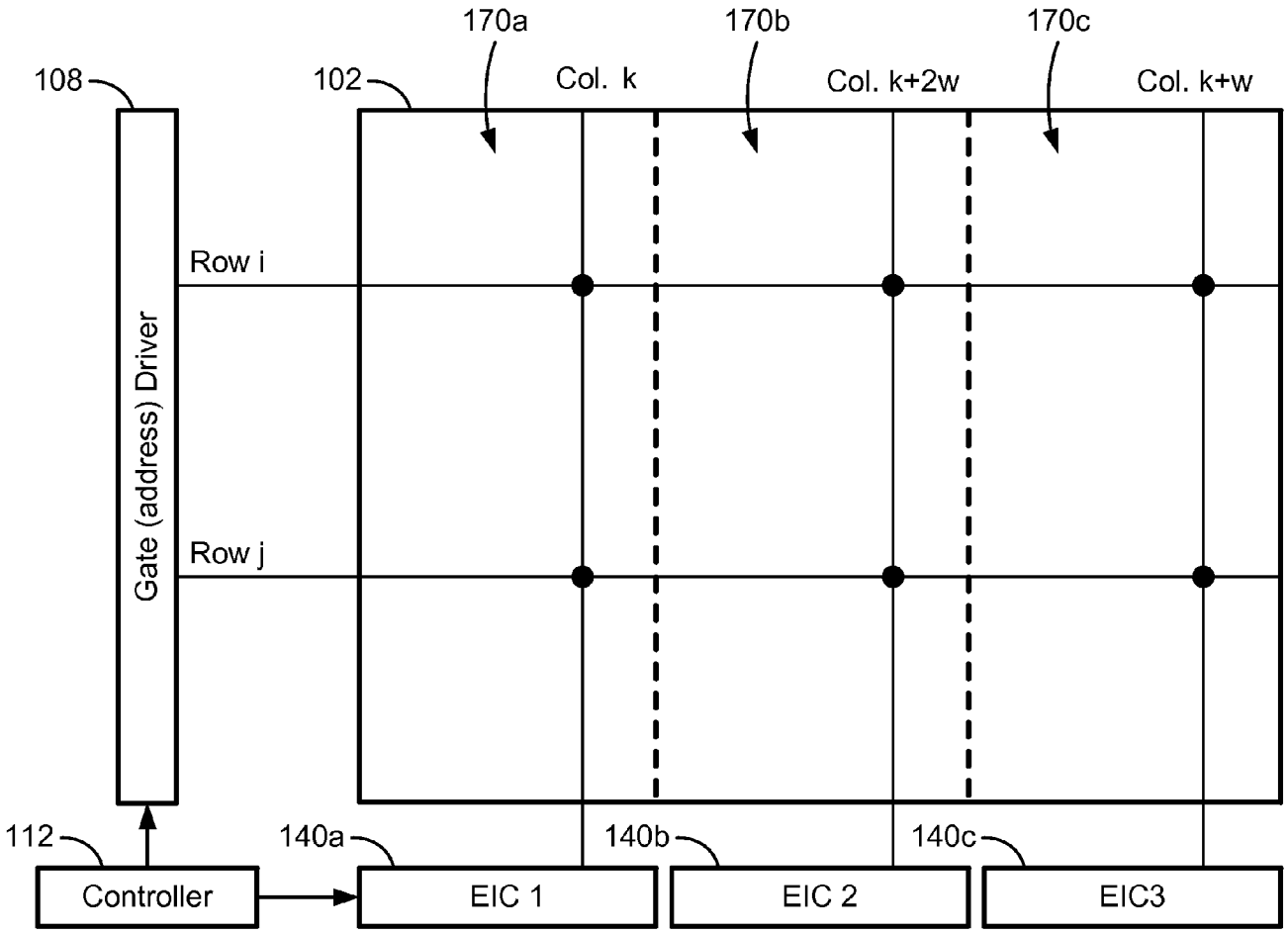
FIG. 1B is a functional block diagram of an example pixel array controlled by three enhancement integrated circuits (EICs), where each EIC controls a block of columns in the pixel array.
Figure 1C:
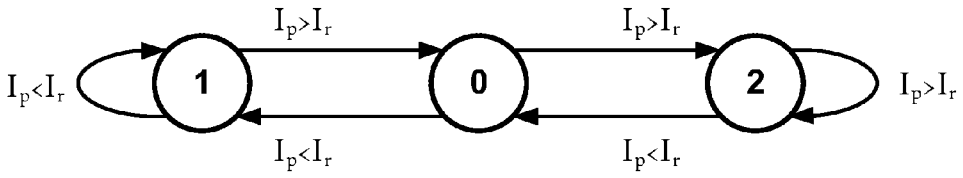
FIG. 1C illustrates an example state-machine used for each pixel to keep track of whether the pixel is in a state of aging, relaxation, or neither.

A pixel array 102 of the display panel 100 is divided in columns (k . . . k+w) into regions or blocks of columns as shown in FIG. 1B, with each block controlled by an enhancement integrated circuit (EIC) 140*a,b,c*, which are connected to the controller 112. Each EIC 140*a,b,c* controls respective regions of pixels 170*a,b,c* of the pixel array 102. During a frame time, a few number of rows (typically two rows for reference pixels and a few for panel pixels), such as rows i and j in FIG. 1B, are selected in each EIC 140*a,b,c* for a defined column (k . . . k+w), and a measurement is performed for the selected pixels. A characteristic of the pixel, such as the drive electrical current used to drive the light emitting device of each pixel 104, $I_p$, is measured and compared with a reference characteristic or value, such as a reference current, $I_r$. The reference current can be obtained from the reference pixel 130 or 132 or from a fixed current source. The comparison determines whether each pixel 104 is overcompensated (in which case, $I_p>I_r$) or aged (in which case, $I_p<I_r$). A state machine, shown in FIG. 1C, for each pixel keeps track of the consequent comparison results of each pixel to determine whether the comparison was due to noise or an actual aging/recovering.

A memory records the absolute aging estimation of all sub-pixels in each clustering scheme (i.e., AbsAge[i, j, color, cs]). If a pixel is in state 1 and Ip<Ir the content of the memory corresponding to that pixel is incremented by 1. The absolute aging value associated with that pixel in the memory is decremented by 1 if that pixel is in state 2 and Ip>Ir. The memory can be conventionally incorporated in or connected to the controller 112. The absolute aging values are examples of reference values that can be used to track whether a pixel has changed relative to a prior measurement of the characteristic of interest (e.g., drive current, $V_{OLED}$, brightness, color intensity) for compensating for a phenomenon that affects pixel performance, efficiency, or lifetime (e.g., aging/relaxation of the drive TFT or light emitting device, color shift, temperature variation, process non-uniformities).

Figure 1D:
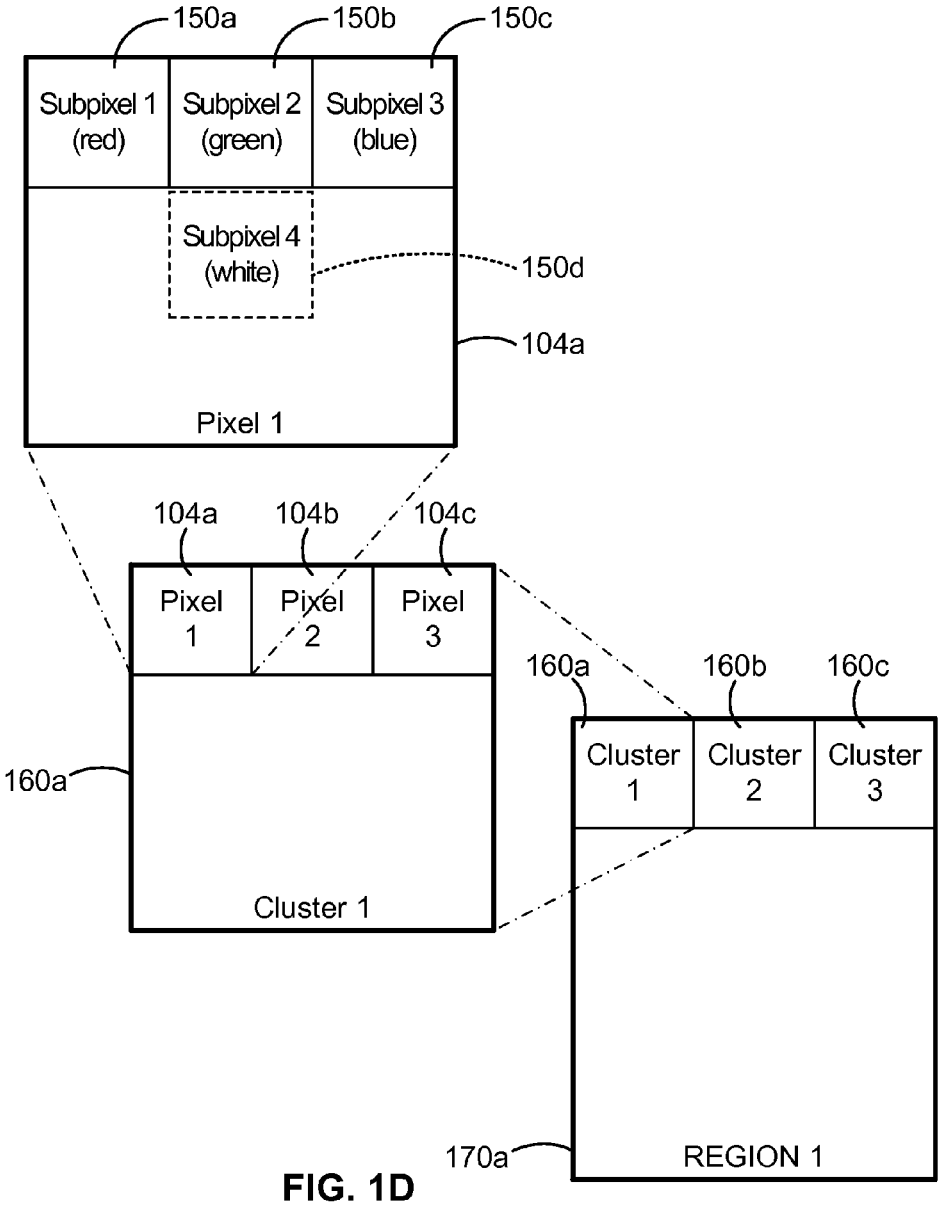
FIG. 1D is a functional block diagram of how a region is comprised of pixel clusters, which is comprised of pixels, which in turn can be comprised of multiple sub-pixels.

Referring to FIG. 1D, one the regions 170*a* is shown. Each region has multiple clusters 160*a,b,c* (three are shown by way of example only) of pixels. A cluster 160*a,b,c* is a grouping of pixels and can typically be rectangular but can be any other shape. Each cluster 160*a* is comprised of multiple pixels 140*a,b,c* (three are shown by way of example only). Each pixel 140*a* can be comprised of one or more "colored" sub-pixels 150*a,b,c*, such as RGB, RGBW, RGB1B2, etc. A sub-pixel 150*a,b,c* is a physical electronic circuit on the display panel 100 that can generate light. The term "pixel" as used herein can also refer to a sub-pixel (i.e., a discrete pixel circuit having a single light emitting device), as it is convenient to refer to sub-pixels as pixels. Finally, as used herein, a clustering scheme is the manner in which the display panel 100 is divided into clusters 160*a,b,c*. For example, a Cartesian grid can be used to divide the panel 100 into rectangular clusters 160*a,b,c*. Spatial shift can be used instead as a variation of the Cartesian grid scheme. Different variations of clustering schemes can be used, or a single clustering scheme can be imposed throughout the compensation process.

The example described in the Background Section above illustrates the highly inefficient performance of a brute-force approach for compensating for the aging/relaxation of pixels. A conventional full-panel scan of each EIC region is a very slow process. Fortunately, the aging/relaxation of the pixels is not purely random. There is strong tendency toward spatial correlation of the aging/relaxation due to the spatial correlation of the video content displayed on the panel 102. In other words, if a pixel 104 is aging/relaxing, losing its brightness, or experiencing a shift in color, drive current, or $V_{OLED}$, there is a high probability that the same phenomenon is affecting other pixels 104 close to this pixel (i.e., neighboring pixels) are also changing. The estimation algorithm according to the present disclosure exploits this tendency to achieve a higher estimation speed to focus the compensation on the areas where characteristic changes are the most severe.

The estimation algorithm disclosed herein is a local priority-based scanning scheme that gives higher priority to scanning areas that are under continuous change. Assuming that a region can be identified as an area needing compensation (e.g., for aging or relaxation), therefore, it is also relevant to use a single measurement data from a single pixel in that area as a candidate to determine whether the rest of the region needs further compensation or not. This intelligence is integrated and designed in a way that the estimation algorithm detects the newly changed areas quickly, while the measurements are already focused on the areas that need high attention.

To leverage the locality of the aging profile, each EIC's region 170*a* is divided into clusters 160*a,b,c* of 8×8 pixels 104 (16×16 sub-pixels 150, for example). The estimation algorithm is composed of two phases (Phase I and Phase II) that run consequently on each cluster 160*a,b,c*. The principal role of Phase I is to determine whether a cluster 160*a,b,c* needs high attention in Phase II or not, as quickly as possible. In this Phase I, a given color (e.g., red, green blue, or white) of the cluster 160*a,b,c* of 64 pixels 104 is scanned just enough to make sure the cluster 160*a,b,c* is not important or until the cluster 160*a,b,c* is fully scanned once. This quick scan ensures that newly emerged changed (e.g., aged/relaxed) areas are detected quickly. However, in Phase II, the notion of priority that is quantified based on previous measurements in the cluster is used to extend the measurements in the cluster 160*a,b,c* for more pixels, as well as to accelerate the changes of the absolute value of the aging/relaxation or other reference value of interest, to accelerate the noise filtering, and to treat the rest of the neighboring pixels to the measured pixel similarly.

Figure 2:
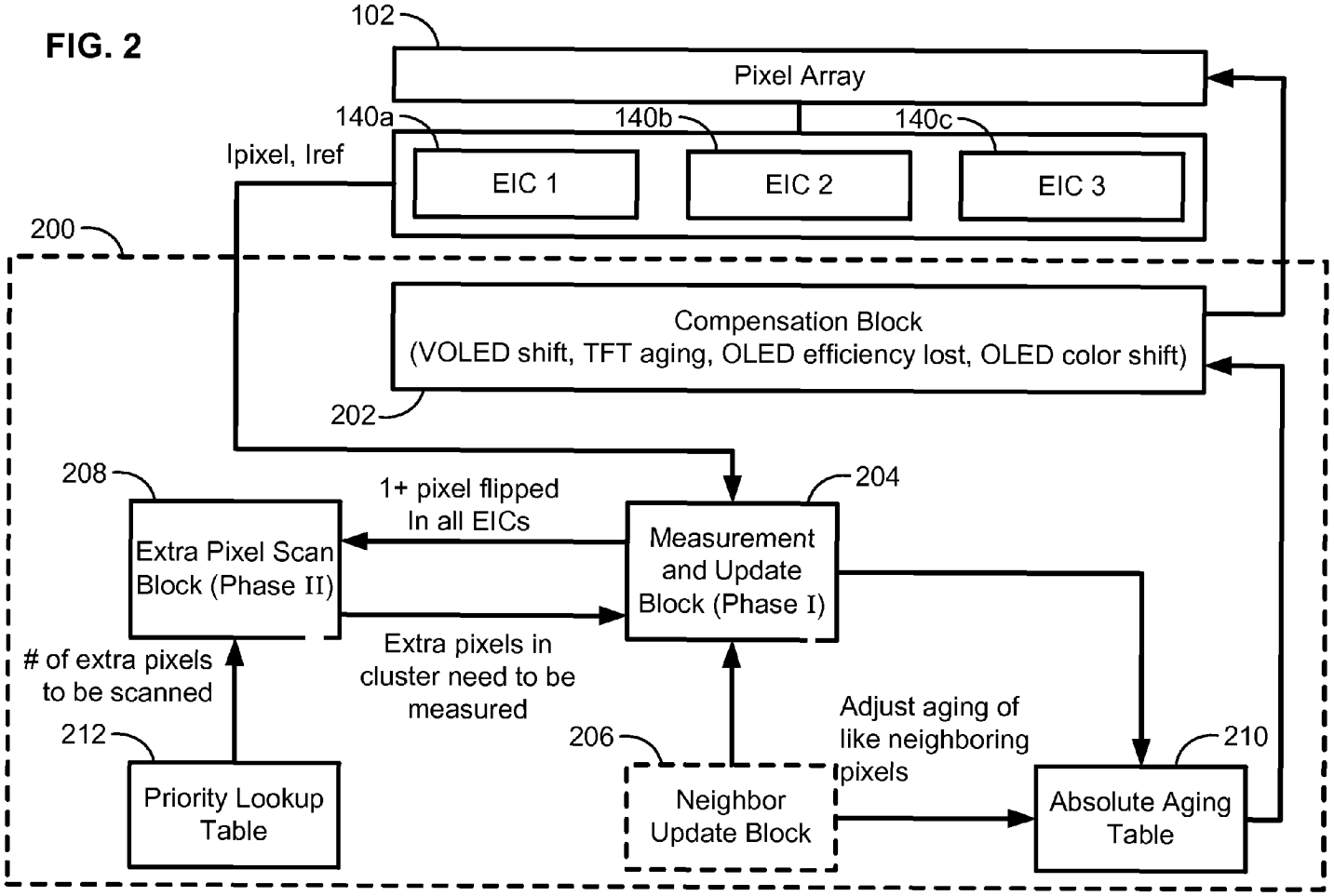
FIG. 2 is a functional block diagram of an example estimation system for estimating areas of high aging/relaxation according to an aspect of the present disclosure.

FIG. 2 is a functional block diagram of components or modules that are associated with the estimation algorithm 200. Each EIC 104*a,b,c* outputs a measured current, $I_{pixel}$, corresponding to a pixel 104 under examination, which represents an amount of current drawn, for example, by the light emitting element in the pixel under an emission or a driving cycle. A reference current, $I_{ref}$, is either provided to or is known by a Measurement and Update Block (Phase I) 204, and the measured pixel is compared with the reference current to determine whether the pixel is in an aging or relaxation state. The state of the pixel (see FIG. 1C) is updated if its state changed relative to a prior measurement. When the characteristic of interest is other than related to the aging or relaxation phenomenon, such as drive TFT current, $V_{OLED}$, pixel brightness, color, or the like, the EIC outputs a measurement signal indicating a measurement of the characteristic, which is compared against a reference value associated with the characteristic, to determine whether the characteristic of interest changed relative to the last measurement.

For now, the major blocks will be described. The details as to each of these blocks will be described below in connection with the flowcharts. The Measurement and Update Block 204 determines whether the state of one or more pixels has flipped (or, more generally, whether a reference value has changed relative to a prior measurement of a pixel characteristic) in the same position in all of the EICs 140*a,b,c* (e.g., pixel A at location i,k in EIC 1 140*a*, pixel B at location i,k in EIC 2 140*b*, and pixel C at location i,k in EIC 3 140*c*), and if so, transfers control of the estimation algorithm to an Extra Pixel Scan Block (Phase II) 208. In Phase II, if the Extra Pixel Scan Block 208 determines that additional pixels need to be measured, the Measurement and Update Block 204 measures the additional pixels and updates the state machine logic corresponding to any of the measured pixels whose state changed relative to a prior measurement. The Extra Pixel Scan Block 208 can interrogate a Priority Lookup Table (LUT) 212 to determine a number of additional pixels to be scanned based on a priority value determined from the number of pixels in a cluster that are in an aging or relaxation state. Thus, the more pixels in a given cluster that are aged/relaxed, the higher priority value can be assigned to that cluster, and therefore more pixels are flagged for further measurement.

The Measurement and Update Block 204 can optionally update neighboring pixels in a like manner that the measured pixel was updated using the optional Neighbor Update Block 206. Thus, if the state of the measured pixel is in the same state as a majority of its neighbors, the absolute aging/relaxation value for those neighboring pixels can be adjusted and updated in an Absolute Aging Table 210, which stores the absolute aging/relaxation values for each of the pixels, as a function of their state as determined in FIG. 1C. The Absolute Aging Table 210 is provided to or accessed by a Compensation Block 202, which as explained above, can be any suitable method, circuit, or algorithm for compensating the pixels that are in an aging/relaxation state, such as compensating for $V_{OLED}$ shift (i.e., a shift in the voltage across the light emitting element in a pixel 104), TFT aging (i.e., a shift in the threshold voltage, $V_T$, for the drive transistor that drives the light emitting element in a pixel 104), OLED efficiency lost (i.e., due to a phenomena other than $V_{OLED}$ shift), or OLED color shift, for example. The Compensation Block 202 outputs signals that are provided back to the pixel array 102 for adjusting the programming voltages, bias currents, supply voltages, and/or timing, for example, to compensate for the aging/relaxation.

Now that the primary blocks have been described with reference to FIG. 2, a high-level description of the estimation algorithm will be described next. The use of the term "step" is synonymous with the term act, function, block, or module. The numbering of each step is not necessarily intended to convey a time-limited order of sequence, but rather simply to differentiate one step from another.

Step 0: Select the first/next clustering scheme. As defined above, a clustering scheme defines how a display panel 100 is divided into clusters. In this example, a rectangular clustering scheme is assumed.

Step 1: Select the first/next color. As explained above, each pixel 104 can be composed of multiple sub-pixels 150, each emitting a different color, such as red, green, or blue.

Step 2: Select the first/next cluster (e.g., start with cluster 160*a*). The scanning can be performed in any desirable order. For example, each of the clusters can be scanned according to a scan order in a top-right to bottom-left order.

Step 3 (Start of Phase I): In the current cluster (e.g., cluster 160*a*), select the next pixel to be measured. Run the Measurement and Update Block 204 for the pixel 104*a* to determine whether its state is aging, relaxed, or neither by comparing in a comparator the measured current for that pixel 104*a* against a reference current, and using an output of the comparator to determine the state of the pixel according to FIG. 1C. The coordinates of the scanned pixel 104*a* can be recorded for the estimation algorithm to pick up the scan next time where it left off this time.

Step 4: Go to Step 3 until the comparison result (0 or 1) flips at least once for all EICs 140*a,b,c*. However, if the loop (Step 3 to Step 4) is repeated sixteen times, break to Step 5. Therefore, if a cluster in one of the EIC regions 170*a* is already aged/relaxed, the comparator output must remain the same (either > or <) for all sixteen measurements (a full cluster scan), otherwise a flip of the comparator stops the continuation of Phase I.

Step 5 (Start of Phase II): Find the maximum priority, $P_{MAX}$, of the current cluster being scanned. The maximum priority is equal to the maximum priorities of corresponding clusters in all of the EICs, optionally including neighboring pixels. The priority value of a cluster in an EIC is the absolute difference of the number of pixels in state 2 (see FIG. 1C) versus the number of pixels in state 1. Therefore, if a cluster is already aged (or relaxed), most of its pixels are in state 1 (or state 2). Note that Phase I guarantees that if the cluster is recently aged/relaxed, the measurement cycles in Phase I have been long enough to have an updated value of the state machines in that cluster.

TABLE 1

| Number of extra scanning pixels with respect to priority. | |
|---|---|
| $P_{MAX} < 11$ | NEx = 0 |
| $10 < P_{MAX} < 15$ | NEx = 4 |
| $14 < P_{MAX} < 20$ | NEx = 8 |
| $19 < P_{MAX} < 26$ | NEx = 18 |
| $25 < P_{MAX} < 33$ | NEx = 32 |
| $32 < P_{MAX}$ | NEx = 48 |

Step 6: Based on the maximum priority, $P_{MAX}$, determined in the Step 5, the number of extra pixels needed to be scanned in this cluster (NEx) is set according to the LUT 212, an example of which is shown in Table 1 above.

Step 7: Scan NEx more target pixels in the cluster (typically in all EICs 140*a,b,c*) starting from the last measured pixel coordinate in Phase I. While scanning, the following tasks based on the priority value of the clusters in each EIC are performed:

Step 7.1 (Neighbor-Update): For each pixel 104 measured in the current frame, if its priority value, P>Thr (e.g., Thr=24 or Thr=30), for its cluster and the state of the pixel 104 remained unchanged after the measurement while it is the same as the state of the majority of the pixels in the cluster, increment/decrement by 1 the absolute aging of the eight pixels neighboring of the measured pixel (in the Absolute Aging Table 210), which have the same color and the same state machine value as the measured pixel. Add 1 if the state of the measured pixel is 1, and subtract 1 if the state of the measured pixel is 2. In this case, optionally divide by 2 the coefficients of the exponential moving average filter of the 8 pixels neighboring the measured pixel, which have the same color and the same state machine value as the measured pixel. This ensures that the averaging (noise filtering) is done with a shorter latency for high-priority clusters. There is a limit beyond which the coefficient of the averaging filter is not divided anymore.

Step 8: Return to Step 1.

Having described the high-level operation of the estimation algorithm, additional considerations will now be described in the following numbered paragraphs.

1. In an exemplary implementation of the aspects of the present disclosure, the absolute value of the estimated aging is added/subtracted by a constant value (e.g. 1 or 2). Alternately, the change in absolute value can be accelerated such that the pixels that are in a high-priority cluster experience a larger change in the absolute aging value relative to pixels that are not in a high-priority cluster.

2. The list of pixels to be scanned can be stored in a Measurement Queue (MQ). To minimize the measurement time of the pixels, the controller 112 can be configured to allow multiple row measurements per frame. Therefore, in Steps 3 and 7 above, extra rows can be measured along with the target pixel. These extra rows are selected such that each row is located in a different cluster, and their corresponding clusters have the top accumulative priorities along EICs. Their local coordinates (row and column) are the same as the target pixel. As used herein, a "target" or a "selected" pixel refers to the particular pixel under measurement or under consideration, as opposed to a neighboring pixel, or a next pixel, which refers to an adjacent pixel to the target or selected pixel under consideration.

3. Whenever the absolute aging value (stored in the Absolute Aging Table 210) is changed by adding/subtracting 1 to its value due to neighbor effects, other related lookup tables such as tables storing the average aging values and delta aging values can also be updated.

4. By way of example, upon initialization of the estimation algorithm, all the cluster priorities can be set to zero, all the state machines of the pixels can be reset to zero, and the last measured pixel position in the cluster can be set randomly or initialized to the top-right pixels in the cluster.

5. The order of the pixel measurements in a cluster can be set as desired. As an example, Table 2 below shows a top-right to bottom-left order for a 64-pixel cluster. The coordinates of last pixel measured in the cluster is stored; therefore, the next visit by the estimation algorithm to that cluster can start measurement from the pixel following to last measured pixel. The next measured pixel after the pixel 64 is pixel 1.

TABLE 2

Example pixel-measuring order in a cluster.

| | | | | | | | |
|---|---|---|---|---|---|---|---|
| 57 | 49 | 41 | 33 | 25 | 17 | 9 | 1 |
| 58 | 50 | 42 | 34 | 26 | 18 | 10 | 2 |
| 59 | 51 | 43 | 35 | 27 | 19 | 11 | 3 |
| 60 | 52 | 44 | 36 | 28 | 20 | 12 | 4 |
| 61 | 53 | 45 | 37 | 29 | 21 | 13 | 5 |
| 62 | 54 | 46 | 38 | 30 | 22 | 14 | 6 |
| 63 | 55 | 47 | 39 | 31 | 23 | 15 | 7 |
| 64 | 56 | 48 | 40 | 32 | 24 | 16 | 8 |

6. The priority value of a cluster is equal to the absolute difference between the number of pixels in State 1 and those in State 2 (see FIG. 1C). A cluster has high priority value if the majority of its pixels are in one of the states, i.e., either State 1 (aged) or State 2 (overcompensated).

Example Pseudo Code is provided below:

```
1-  Initialization
2-  While (true)                                    // The main loop
3-      Shift the clusters by 4 pixels to right and bottom or return back if already shifted
4-      For all colors                              // R, G, and B
5-          For all cluster rows                    // From top to bottom
6-              For all cluster columns             // From right to left
7-                  Enter Phase I
8-      Select the next target pixel according to top-bottom, then right-left order in the current
                cluster. Start after the last measured pixel. If already at the end of the cluster,
                start over, from the top right pixel in the cluster.
9-      Sort the priority values of the clusters on top and bottom of the current cluster, based on
                the accumulative priority values of the clusters across all EICs. Choose the top-
                priority clusters for extra row pixel measurement.
10-     Record the last current comparison results in the target cluster of all EICs, to be later used
                for checking for a flip (transition).
11-     Perform the measurement on all selected rows for all EICs by comparing the measured
                current for a target pixel with a reference current to determine which state
                (according to FIG. 1C) the pixel is in.
```

-continued

```
12-     For all selected cluster rows in step 9
13-     If the priority value of the cluster >30, then
14-     Multiply the abs step size by 2 with a maximum to 8
15-     Divide the averaging filter coefficient by 2 with a minimum of 4
16-     Else
17-     Divide the abs step size by 2 with a minimum of 1
18-     Multiply the averaging filter coefficient by 2 with a maximum of 64
19-     End If
20-     End For
21-     Update the abs, average and delta look up tables.
22-     Calculate and update the priorities.
23-     If it is Phase I, less than 16 measurements are done in the current cluster, and not all of
                the target clusters in different EICs have already experienced a flip, then goto 8.
24-     Enter Phase II.
25-     For all measured pixels
26-     If the state machine of the pixel is not changed and the state is the same as the state of the
                majority of the pixels in the cluster, then
27-     If the priority value of the cluster>24, then
28-     Add/subtract by 1 to any of the 3x3 same-color pixels surrounding the measured pixel, if
                their state (e.g., 0, 1, or 2) is the same as the measure pixel.
29-     Divide the averaging filter coefficient of neighbors by 2 with a minimum of 4.
30-     End If
31-     End If
32-     End For
33-     If the state machine of the target pixel is not changed and the state is the same as the state
                of the majority of the pixels in the cluster, then only for one time in this cluster
34-     End If
35-             End For
36-         End For
37-     End For
38- End While
```

The flowcharts in FIGS. 3-6 implement an example aspect of an estimation algorithm 300 from which the pseudo code can be modeled. The first or next clustering scheme is selected (302) as described above. For example, the clustering scheme can be rectangular, with each cluster defining a group of pixels having a predetermined number of rows and columns. The first or next color is selected (304), such as red, then green, then blue. At initialization, a first color is selected (e.g., red). As noted above, each pixel 104 can be composed of multiple sub-pixels 150, each emitting a different color of light. A cluster variable, c, is associated with the first (if this is the first time through the algorithm) or next cluster (if a previous cluster has already been scanned) (306). A flip register, Flip_reg, is initialized to zero in Phase I (308). A next pixel variable, s, is associated with the first or next pixel to be measured in the cluster, c (310). The pixel s is passed to the Measurement and Update Block 204 (312), described in connection with FIGS. 4A and 4B below.

The estimation algorithm 300 determines whether it is in Phase I or Phase II (314). If the phase is Phase I, the flip register, flip_reg, is updated to reflect whether a state of the measured pixel s changed relative to a prior measurement (316). The estimation algorithm 300 determines whether a state of a pixel, at the same coordinate position as the pixel s in the current EIC being scanned, in each of the other EICs has flipped (e.g., the state of the pixel has changed from aged to relaxed). If not, the estimation algorithm 300 determines whether the last pixel in the cluster has been measured (320). If not, the estimation algorithm 300 continues to measure that pixel's current draw and update the Absolute Aging Table 210 until either the state of the pixels in the same coordinate position in all of the EICs has flipped (318) or all of the pixels in the current cluster have been scanned (320).

If all of the pixels in the cluster have been scanned, the estimation algorithm 300 determines whether additional clusters need to be scanned (322). If additional clusters remain to be scanned, the cluster variable, c, is associated with the next cluster (e.g., the cluster immediately adjacent to the cluster that was just scanned) (306) and that next cluster's pixels are scanned to determine their respective states and whether those states have changed relative to a prior measurement.

If all of the clusters have been scanned, the estimation algorithm 300 determines whether the last color have been scanned (e.g., if red was selected first, blue and green remain to be scanned) (324). If more colors remain to be scanned, the next color is selected (304), and the clusters for that next color are scanned (308), (310), (312), (314), (316), (318), (320), (322). If all colors have been scanned (e.g., red, blue, and green), the estimation algorithm 300 determines whether the last clustering scheme has been selected (326). If not, the algorithm 300 selects the next clustering scheme 302, and repeats the scanning for all colors and clusters according to the next clustering scheme. If so, the algorithm 300 repeats from the beginning.

Returning to block 318, if the pixel at the same coordinate location in all of the EICs has changed its state (e.g., flipped from aged to relaxed), the algorithm 300 enters Phase II (336), and calls a module or function called Find-NEx (334), which corresponds to the Extra Pixel Scan Block 208 shown in FIG. 2. The Find-NEx algorithm 334 is described in more detail in connection with FIG. 5 below.

The first time through the Phase II loop, an extra count variable, CntEx, is initialized to zero (332) and incremented each pass through the loop (330). The Find-NEx algorithm 334 returns a value, NEx, corresponding to the number of additional pixels that need to be scanned, for example, based on Table 1 above. A temporary counter, CntP2, keeps track of the number of times through the Phase II loop. The algorithm 300 iterates through the Phase II loop (320, 310, 312, 314, 330, 328) until all of the additional pixels corresponding to the number of extra pixels (NEx) have been scanned by the Measurement and Update Block 204 (312), each time incrementing the CntEx and CntP2 variables with each pass through the Phase II loop.

Figure 4A:
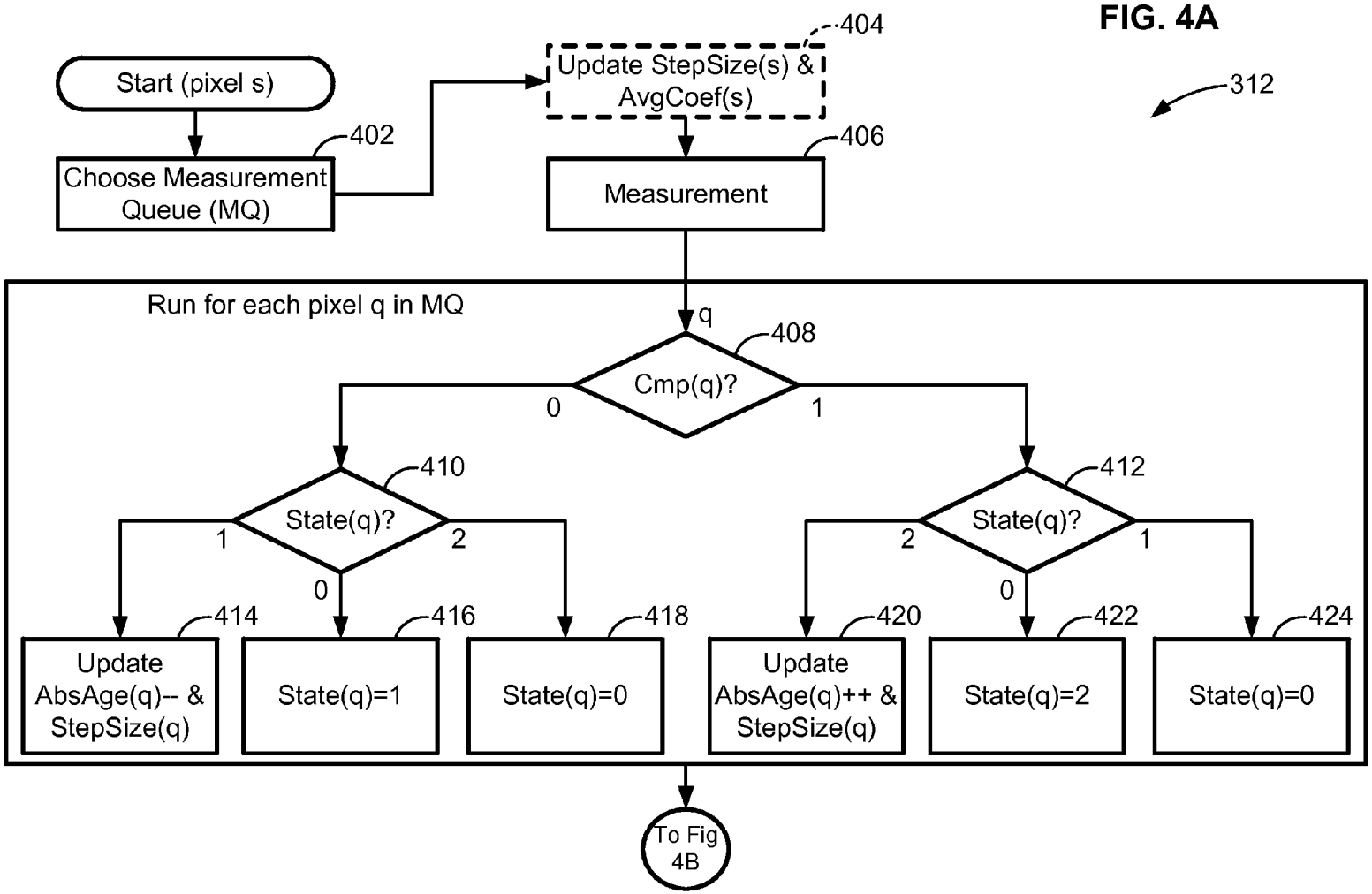
FIGS. 4A and 4B are a flowchart diagram of a Measurement and Update algorithm according to an aspect of the present disclosure, which is called during Phase I or Phase II of the estimation algorithm of FIG. 3.
Figure 4B:
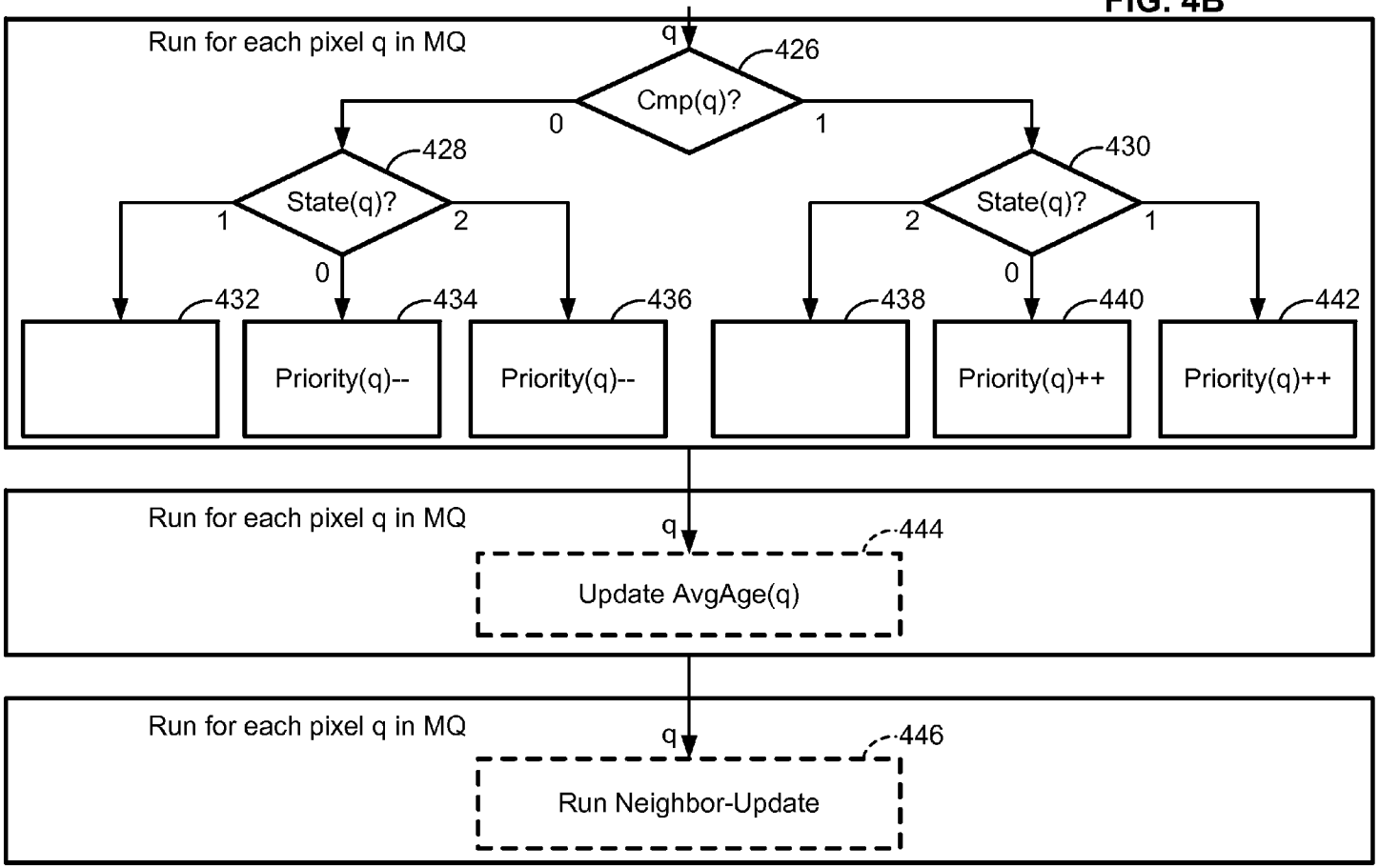

The Measurement and Update Block 204 (312) is shown as a flowchart diagram in FIGS. 4A and 4B. The target pixel to be scanned is the pixel s inputted to the Measurement and Update algorithm 312 by the estimation algorithm 300. A Measurement Queue (MQ) specifying the order and coordinate locations of the pixels to be scanned is selected (402). Each pixel in the Measurement Queue is assigned a variable q in this algorithm 312, to differentiate these pixels from the pixel s being iterated through the main estimation algorithm 300. Optionally, depending on the priority value of the cluster, the step size and the average filter coefficient can be updated (404), such as described in steps 12-18 of the pseudo-code above.

The measurement block (406) measures the current drawn by the target pixel s and compares it against a reference current in a comparator. For each pixel q in the Measurement Queue, the Measurement and Update algorithm 312 determines the comparator's output (408). If the output has not flipped, the algorithm 312 determines the state of the pixel (410), according to FIG. 1C. If the previous state of the pixel q in the Measurement Queue is 1 (aging), the algorithm 312 updates that pixel's absolute aging value in the Absolute Aging Table 210 (410) by decrementing it by one and optionally updates the step size for that pixel q. If the previous state of the pixel q is 0, the state of the pixel q is changed to state 1 (416). If the previous state of the pixel q is 2 (overcompensated), the state of the pixel q is changed to state 0 (418).

If the output of the comparator has flipped (408) and indicates a 1, the state of the pixel q is updated as follows (412). If the previous state of the pixel q was 2 (overcompensated), the absolute aging value for that pixel q is incremented by 1 in the Absolute Aging Table 210 and optionally updates the step size for that pixel (420). If the previous state of the pixel q was 0, the state of the pixel q is changed to state 2 (422). If the previous state of the pixel q was 1, the state of the pixel q is changed to state 0 (424).

The algorithm 312 continues to FIG. 4B, at which the comparator output is read (426). If the comparator output has not changed (426), the priority value associated with the pixel q is decremented in the state of the pixel q (428) is state 0 or state 2 (434, 436). Otherwise, if the state of the pixel q is state 1 (aged), the priority value is unchanged (432). If the comparator output has flipped (426), the priority value associated with the pixel q is incremented if the state of the pixel q (430) is state 0 or state 1 (440, 442). Otherwise, if the state of the pixel q is state 2 (overcompensated), the priority value is unchanged (438).

Optionally, for each pixel q in the Measurement Queue, the average aging value associated with the pixel q can be updated (444). Optionally, for each pixel q in the Measurement Queue, the neighboring pixels can also be updated in the Neighbor-Update algorithm 446 shown in FIG. 6 and described below. Thereafter, control is returned to the estimation algorithm 300.

Figure 3:
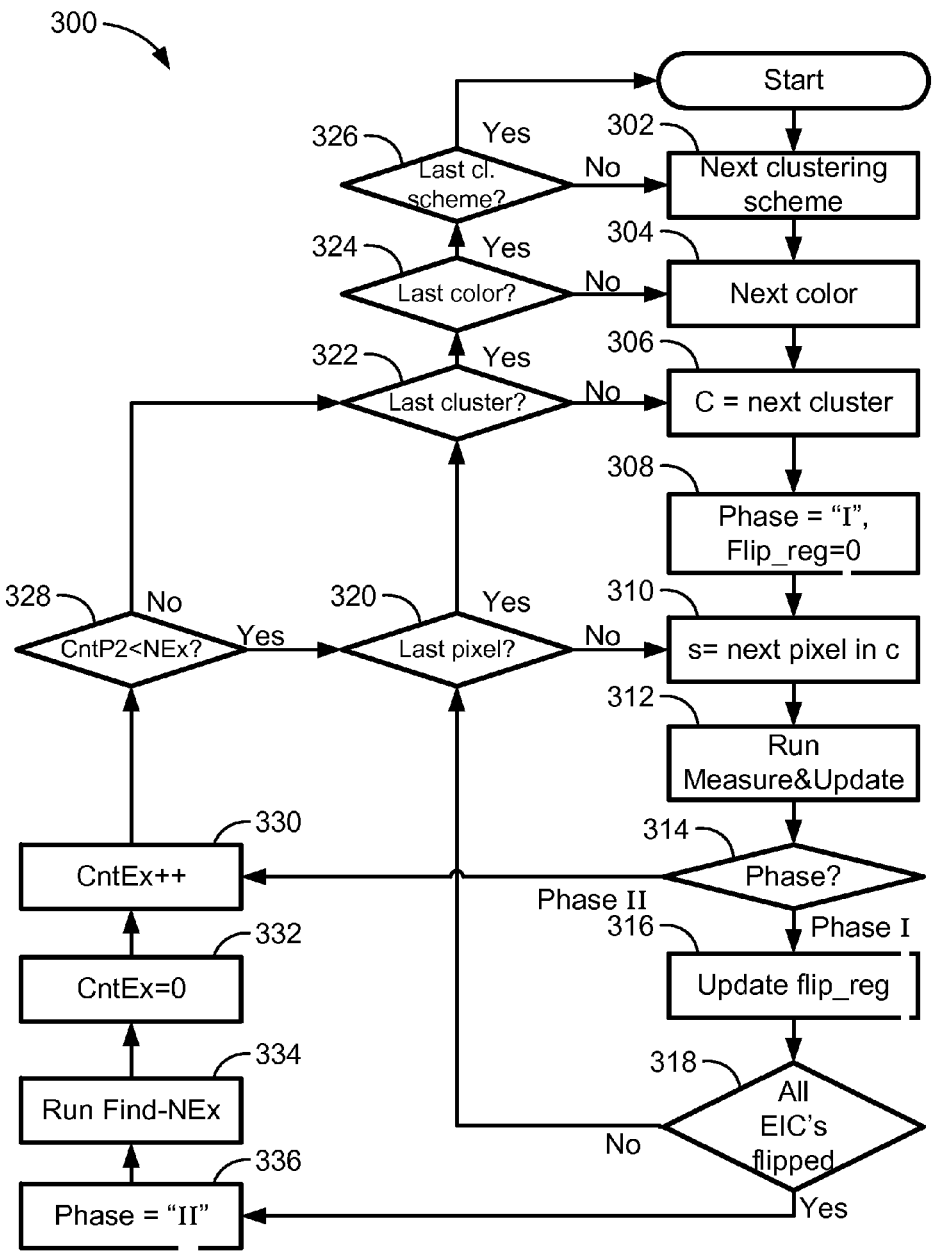
FIG. 3 is a flowchart diagram of an estimation algorithm according to an aspect of the present disclosure.
Figure 5:
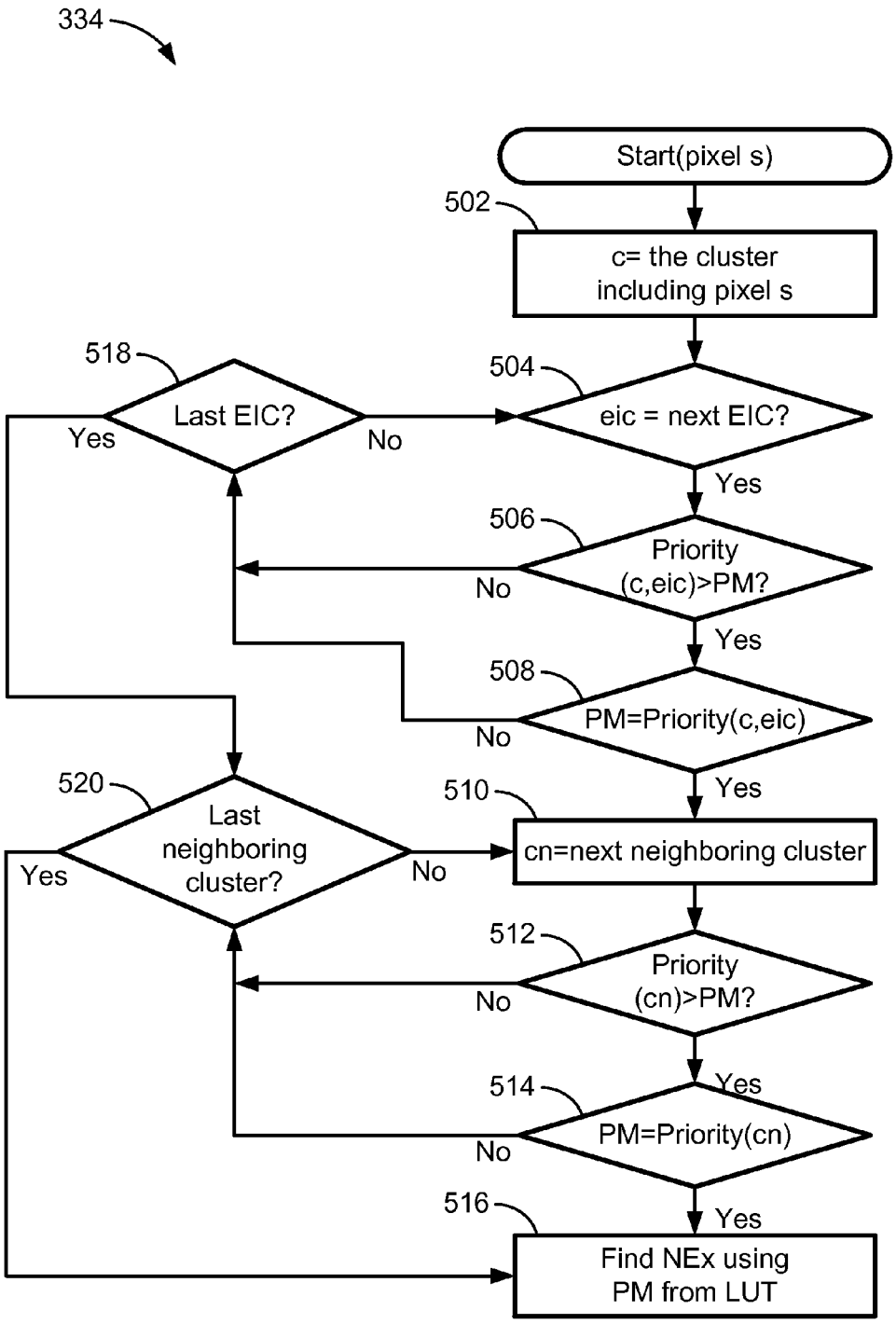
FIG. 5 is a flowchart diagram of an algorithm for finding a number of additional pixels to be scanned according to an aspect of the present disclosure, which is called during Phase II of the estimation algorithm of FIG. 3.

FIG. 5 is a flowchart diagram of an algorithm for finding a number of extra pixels to be scanned, called Find-NEx 334 in the estimation algorithm 300 described in FIG. 3 above. In this algorithm 334, a priority value is assigned to the cluster and based on the priority value a number of additional pixels to be scanned is determined based on a lookup table, such as the Priority Lookup Table 212 shown in FIG. 2. The Find-NEx algorithm 334 can be incorporated into the Extra Pixel Scan Block 208 shown in FIG. 2. The algorithm 334 starts with pixel s and the cluster c is the cluster in which the pixel s is located. The algorithm 334 iterates through all of the EICs, starting with the EIC of the current cluster c (504). The algorithm 334 determines the priority value for the current or target cluster in the target EIC by calculating the absolute difference of the number of pixels in state 2 versus state 1, and determines whether the priority value exceeds a maximum priority $P_{MAX}$ (shortened to PM in FIG. 5 for ease of illustration), as defined above (506). If the maximum priority PM is equal to the calculated priority value for the target cluster in the target EIC, the algorithm 334 defines a next cluster variable cn to be associated with the next neighboring cluster (e.g., the immediately adjacent cluster to the target cluster) (510). The algorithm 334 determines whether the priority value of the next cluster cn exceeds the maximum priority PM (512). If so, the algorithm 334 determines whether the maximum priority PM is equal to the calculated priority value of the next cluster cn (514). If so, the algorithm looks up NEx corresponding to the maximum priority PM from the Priority Lookup Table 212 (516) and passes the NEx value back to the algorithm 300.

Returning to block 506, if the calculated priority value for the target cluster c in the target EIC does not exceed the maximum priority PM, the algorithm 334 determines whether additional EICs need to be scanned (518). Returning to block 508, if the maximum priority PM is not equal to the calculated priority value for the target cluster in the target EIC (508), the algorithm 334 determines whether additional EICs need to be scanned (518). If all EICs have been scanned to assess their clusters' priorities, the algorithm 334 determines whether the last neighboring cluster in the target EIC has been scanned (520). If not, the next neighboring cluster (e.g., the immediately adjacent cluster to the target cluster c) is scanned to determine its associated priority value (510, 512, 514). Returning to blocks 512 and 514, if the priority value of the neighboring cluster cn does not exceed the maximum priority PM (512) or if the maximum priority PM does not equal the calculated priority value for the neighboring cluster cn (514), the algorithm 334 determines whether more neighboring clusters need to be scanned (520). Once all clusters have been scanned (520) in the target EIC, the NEx value is retrieved from the Priority Lookup Table 212 and returned to the algorithm 300.

Figure 6:
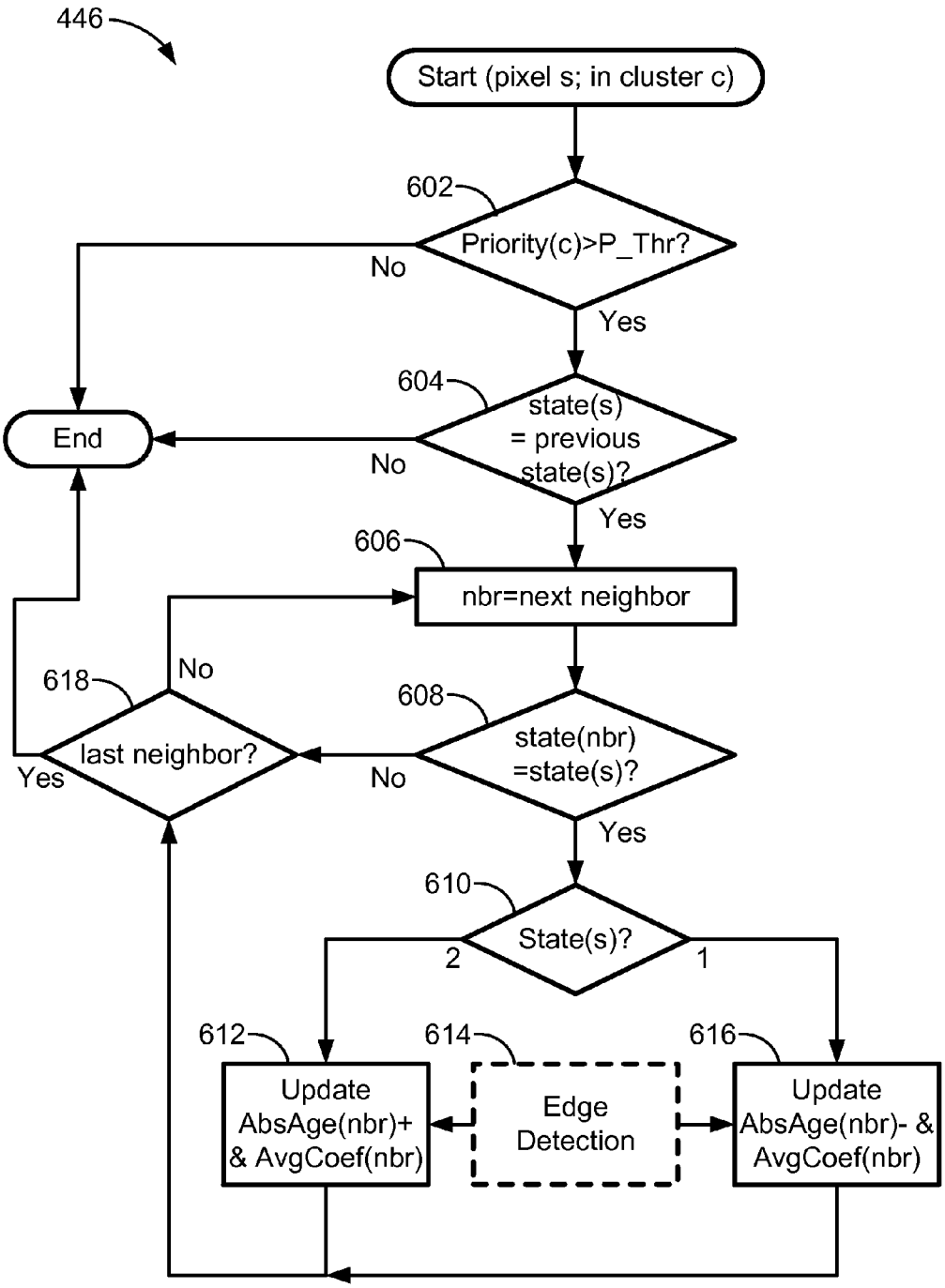
FIG. 6 is flowchart diagram of a Neighbor Update algorithm called by the Measurement and Update algorithm of FIG. 4B.

FIG. 4B referred to an optional Neighbor-Update Block 206 (446), and that algorithm is shown as a flowchart in FIG. 6. The algorithm 446 starts with the target pixel s in the target cluster c (the cluster in which the target pixel is located). If the priority value associated with the cluster exceeds a minimum threshold priority value, P_Thr (602), the algorithm 446 determines whether the state of the target pixel s remained unchanged after the measurement (i.e., it was in state 1 before and after the measurement was taken comparing its pixel current against a reference current) (604). If so, a next neighbor variable, nbr, is defined (606). For example, the 3×3 array of pixels immediately surrounding the target pixel s can be selected as neighbors. The algorithm 446 determines whether the state of the neighboring pixel is the same as that of the target pixel s (608). If not, the algorithm 446 determines whether the last neighbor (e.g., in the 3×3 array) has been analyzed (618), and if not, the next neighboring pixel, nbr, in the cluster c is analyzed (606). If so (618), the algorithm 446 returns control to the estimation algorithm 300.

Returning to block 608, if the state of the neighboring pixel, nbr, is identical to the state of the target pixel s, the algorithm 446 determines the state of the pixel s (610). If the state of the pixel s is state 1 (aged), the absolute aging value for the neighboring pixel, nbr, is decremented by one and the average filter coefficient for the neighboring pixel nbr is updated as explained above in Step 7.1 (616). If the state of the pixel s is state 2 (overcompensated), the absolute aging value for the neighboring pixel nbr is incremented by one and the average filter coefficient for nbr is updated (612). The algorithm 446 determines whether there are further neighboring pixels to be analyzed (618) and if not, returns control to the algorithm 300. The absolute aging values and the average filter coefficients can be adjusted based on an Edge Detection block (614).

Any of the methods described herein can include machine or computer-readable instructions for execution by: (a) a processor, (b) a controller, such as the controller 112, and/or (c) any other suitable processing device. Any algorithm, such as those represented in FIGS. 3-6, software, or method disclosed herein can be embodied as a computer program product having one or more non-transitory tangible medium or media, such as, for example, a flash memory, a CD-ROM, a floppy disk, a hard drive, a digital versatile disk (DVD), or other memory devices, but persons of ordinary skill in the art will readily appreciate that the entire algorithm and/or parts thereof could alternatively be executed by a device other than a controller and/or embodied in firmware or dedicated hardware in a well known manner (e.g., it may be implemented by an application specific integrated circuit (ASIC), a programmable logic device (PLD), a field programmable logic device (FPLD), discrete logic, etc.).

It should be noted that the algorithms illustrated and discussed herein as having various modules or blocks that perform particular functions and interact with one another. It should be understood that these modules are merely segregated based on their function for the sake of description and represent computer hardware and/or executable software code which is stored on a computer-readable medium for execution on appropriate computing hardware. The various functions of the different modules and units can be combined or segregated as hardware and/or software stored on a non-transitory computer-readable medium as above as modules in any manner, and can be used separately or in combination.

While particular implementations and aspects of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. A method of compensating for adverse phenomena of pixels of a display panel comprising a plurality of areas, each pixel comprising a drive transistor and a light-emitting device, the method comprising:

tracking for each pixel, characteristic data representing at least one characteristic indicative of at least one adverse phenomenon associated with the pixel;

during a frame period, measuring the at least one characteristic of a number of pixels of each area, the number of pixels of each area measured determined to be larger for an area continuously exhibiting the at least one adverse phenomenon than for an area not continuously exhibiting the at least one adverse phenomenon;

updating the characteristic data for the number of pixels of the display based on measurements of the number of pixels of each area; and compensating for the at least one adverse phenomenon for at least the number of pixels of each area with use of updated characteristic data of the number of pixels of each area.

2. The method of claim 1 wherein the number of pixels comprises a first plurality of pixels, each area of the plurality of areas comprises at least one cluster of pixels, and measuring the at least one characteristic of a number of pixels of each area comprises:

during a first scanning phase, measuring the at least one characteristic for the first plurality of pixels in the at least one cluster of pixels, the number of pixels in the first plurality of pixels determined based on changes in time of the at least one characteristic for each of the first plurality of pixels in the at least one cluster, wherein updating the characteristic data for the number of pixels of each area comprises updating the characteristic data for the first plurality of pixels of each area based on measurements of the first plurality of pixels of each area and wherein compensating for the at least one adverse phenomenon for at least the number of pixels of each area comprises compensating for the at least one adverse phenomenon for at least the first plurality of pixels of each area with use of updated characteristic data of the first plurality of pixels of each area.

3. The method of claim 2 wherein the number of pixels measured during the first scanning phase when the at least one characteristic of the first plurality of pixels has changed in time is larger than the number of pixels measured during the first scanning phase when the at least one characteristic of the first plurality of pixels has remained constant.

4. The method of claim 2, wherein measuring the at least one characteristic of each pixel comprises determining a state of the at least one characteristic, wherein the characteristic data comprises stored state data of the at least one characteristic of the pixel and absolute deviation data representing an accumulated absolute deviation of the at least one characteristic of the pixel.

5. The method of claim 4, wherein updating the characteristic data for the first plurality of pixels comprises updating the stored state data and the absolute deviation data for the first plurality of pixels.

6. The method of claim 5, wherein the at least one characteristic comprises drive current indicative of aging and drive current indicative of overcompensation, and wherein the at least one adverse phenomenon comprises aging and overcompensation.

7. The method of claim 5 further comprising:

compensating for the at least one adverse phenomenon for pixels of the display for which characteristic data is stored with use of the absolute deviation data stored for those pixels.

8. The method of claim 5, wherein the at least one characteristic comprises at least one of drive-current, light-emitting device voltage, pixel brightness, and colour intensity.

9. The method of claim 8, wherein the at least one adverse phenomenon comprises at least one of aging, compensation, temperature variation, and process variation.

10. The method of claim 1 further comprising:

compensating for the at least one adverse phenomenon for at least one pixel neighboring the number of pixels of the display of each area based on measurements of the number of pixels of each area.

11. The method of claim 1 wherein the number of pixels comprises a second plurality of pixels, each area of the plurality of areas comprises at least one cluster of pixels, and measuring the at least one characteristic of a number of pixels of each area comprises:

during a second scanning phase, measuring the at least one characteristic for the second plurality of pixels in the at least one cluster of pixels, the number of pixels in the second plurality of pixels determined based on the at least one characteristic for all of the pixels of a cluster of the at least one cluster, wherein updating the characteristic data for the number of pixels of each area comprises updating the characteristic data for the second plurality of pixels of each area based on measurements of the second plurality of pixels of each area and wherein compensating for the at least one adverse phenomenon for at least the number of pixels of each area comprises compensating for the at least one adverse phenomenon for at least the second plurality of pixels of each area with use of updated characteristic data of the second plurality of pixels of each area.

12. The method of claim 11, wherein the number of pixels measured during the second scanning phase when a total number of pixels of the cluster that have a state of the at least one characteristic indicative of at least one adverse phenomenon exceeds a total number of pixels of the cluster that have a different state is greater than the number of pixels measured during the second scanning phase when a total number of pixels of the cluster that have a state of the at least one characteristic indicative of at least one adverse phenomenon equals a total number of pixels of the cluster that have a different state.

13. The method of claim 12, wherein measuring the at least one characteristic of each pixel comprises determining a state of the at least one characteristic, wherein the characteristic data comprises stored state data of the at least one characteristic of the pixel and absolute deviation data representing an accumulated absolute deviation of the at least one characteristic of the pixel.

14. The method of claim 13, wherein updating the characteristic data for the second plurality of pixels comprises updating the stored state data and the absolute deviation data for the second plurality of pixels.

15. The method of claim 14, wherein the at least one characteristic comprises drive current indicative of aging and drive current indicative of overcompensation, and wherein the at least one adverse phenomenon comprises aging and overcompensation.

16. The method of claim 14 further comprising:

compensating for the at least one adverse phenomenon for pixels of the display for which characteristic data is stored with use of the absolute deviation data stored for those pixels.

17. The method of claim 14, wherein the at least one characteristic comprises at least one of drive-current, light-emitting device voltage, pixel brightness, and color intensity.

18. The method of claim 17, wherein the at least one adverse phenomenon comprises at least one of aging, compensation, temperature variation, and process variation.

* * * * *